US010245606B2

(12) United States Patent
Chiu et al.

(10) Patent No.: US 10,245,606 B2
(45) Date of Patent: Apr. 2, 2019

(54) TOUCH SPRAY HEAD

(71) Applicant: Globe Union Industrial Corp., Taichung (TW)

(72) Inventors: Huiling Chiu, Taichung (TW); Chiahua Yuan, Taichung (TW); Yiping Lin, Taichung (TW); Yuanhao Chang, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 15/857,956

(22) Filed: Dec. 29, 2017

(65) Prior Publication Data

US 2018/0141068 A1 May 24, 2018

Related U.S. Application Data

(63) Continuation-in-part of application No. 15/189,087, filed on Jun. 22, 2016.

(51) Int. Cl.
*E03C 1/04* (2006.01)
*E03C 1/10* (2006.01)
(Continued)

(52) U.S. Cl.
CPC ..... *B05B 12/002* (2013.01); *E03C 1/0405* (2013.01); *E03C 1/10* (2013.01); *F16K 31/52475* (2013.01)

(58) Field of Classification Search
CPC ..... E03C 1/0404; E03C 1/084; E03C 2001/0415; E03C 2001/0417;
(Continued)

(56) References Cited

U.S. PATENT DOCUMENTS 4,606,370 A * 8/1986 Geipel ..... F16K 11/0445 137/119.05
7,344,095 B1 * 3/2008 Hsu ..... B05B 1/1618 239/444
(Continued)

FOREIGN PATENT DOCUMENTS

TW I228578 B 3/2005
TW M382408 U 6/2010
(Continued)

*Primary Examiner* — Marina A Tietjen
*Assistant Examiner* — Frederick D Soski
(74) *Attorney, Agent, or Firm* — Alan D. Kamrath; Kamrath IP Lawfirm, P.A.

(57) ABSTRACT

A touch spray head is removably connected on an outlet of a faucet body and contains: a casing, a fixing cylinder, a water valve, and a manual operation. The casing includes a surrounding fence, an accommodation space, and a through hole. The fixing cylinder is housed in the accommodation space and includes an inlet segment communicating with the outlet, an outlet segment, at least one first orifice defined between the inlet segment and the outlet segment, and a receiving zone. The water valve is accommodated in the fixing cylinder and includes an operation bar touched to movably turn on the water valve. The manual operation device is housed in the receiving zone and the through hole, and the manual operation device includes a driving portion formed in the through hole so as to be driven by a user to actuate the operation bar to move.

20 Claims, 49 Drawing Sheets

(51) Int. Cl.
*B05B 12/00* (2018.01)
*F16K 31/524* (2006.01)

(58) Field of Classification Search
CPC .... E03C 1/0405; E03C 1/10; Y10T 137/9464; B05B 12/002
See application file for complete search history.

(56) References Cited

U.S. PATENT DOCUMENTS

| | | | | |
|---|---|---|---|---|
| 8,424,781 | B2 * | 4/2013 | Rosko | B05B 1/1618 239/449 |
| 2004/0112985 | A1 * | 6/2004 | Malek | B05B 1/1618 239/445 |
| 2008/0067264 | A1 * | 3/2008 | Erickson | B05B 1/1618 239/445 |
| 2008/0105764 | A1 * | 5/2008 | Jianglin | B05B 1/1618 239/526 |
| 2011/0100494 | A1 * | 5/2011 | Wang | E03C 1/04 137/801 |
| 2015/0184366 | A1 * | 7/2015 | Zhang | B05B 1/1618 4/678 |

FOREIGN PATENT DOCUMENTS

| | | |
|---|---|---|
| TW | M432670 | 7/2012 |
| TW | I369459 B | 8/2012 |
| TW | M452280 U | 5/2013 |

* cited by examiner

TOUCH SPRAY HEAD

This application is a Continuation-in-Part of application Ser. No 15/189,087, filed Jun. 22, 2016.

BACKGROUND OF THE INVENTION

Field of the Invention

The present invention relates to a touch spray head which turns on/off water in a manual operation manner.

Description of the Prior Art

A conventional control valve for a spray head of a faucet is manufactured at high cost and is complicated. Accordingly, improved touch control valves were disclosed in TW Patent Nos. M432670, 1228578, 1369459, M452280 and M382408, respectively. The improved touch control valves are an automatic valve or a manual valve, wherein when the touch control valves are the manual valve, water supply is stopped by touching an actuation element, after starting the water supply. When the touch control valves are the automatic valve, the water supply is stopped automatically by way of water pressure change after a period of using time.

In addition, one touch control valves are sold by many companies, such as 3M, wherein each one touch control valve is fixed on an outlet of the faucet and the water supply is started or stopped by manually touching an actuation element in the control valve, thus causing contamination to the actuation element.

A conventional faucet contains a handle and a central shaft driven by the handle so as to control water supply or to adjust temperature of the water supply. But an operation travel is too long to operate the faucet smoothly and to obtain aesthetics appearance of the control valve.

Another conventional faucet contains an infrared sensor disposed on a body so as to sense user's hand by which water is supplied, yet the conventional faucet cannot be controlled as the infrared sensor or a circuit board is broken.

The present invention has arisen to mitigate and/or obviate the afore-described disadvantages.

SUMMARY OF THE INVENTION

The primary aspect of the present invention is to provide a touch spray head in which the water valve is driven by the tubular part so as to avoid touching and contaminating the water valve.

Further aspect of the present invention is to provide a touch spray head which sprays the water in different water spraying modes by way of the switch valve assembly.

Another aspect of the present invention is to provide a touch spray head in which the tubular part is rotatably connected with the fixing cylinder so as to simplify the touch spray head and to reduce fabrication cost.

To obtain the above aspects, a touch spray head provided by the present invention is removably connected on an outlet of a faucet body and contains: a casing, a fixing cylinder, a water valve, a manual operation device.

The casing includes a surrounding fence, an accommodation space defined inside the surrounding fence, and a through hole formed on the surrounding fence and communicating with the accommodation space.

The fixing cylinder is housed in the accommodation space of the casing and includes an inlet segment communicating with the outlet of the faucet body, an outlet segment, at least one first orifice defined between the inlet segment and the outlet segment, and a receiving zone.

The water valve is accommodated in the fixing cylinder and includes an operation bar touched to movably turn on the water valve so that the water flows into the at least one first orifice of the fixing cylinder from the outlet of the faucet body;

The manual operation device is housed in the receiving zone of the fixing cylinder and the through hole of the casing, and the manual operation device includes a driving portion formed in the through hole so as to be driven by a user to actuate the operation bar of the water valve to move.

DETAILED DESCRIPTION OF THE PREFERRED EMBODIMENTS

Figure 1:
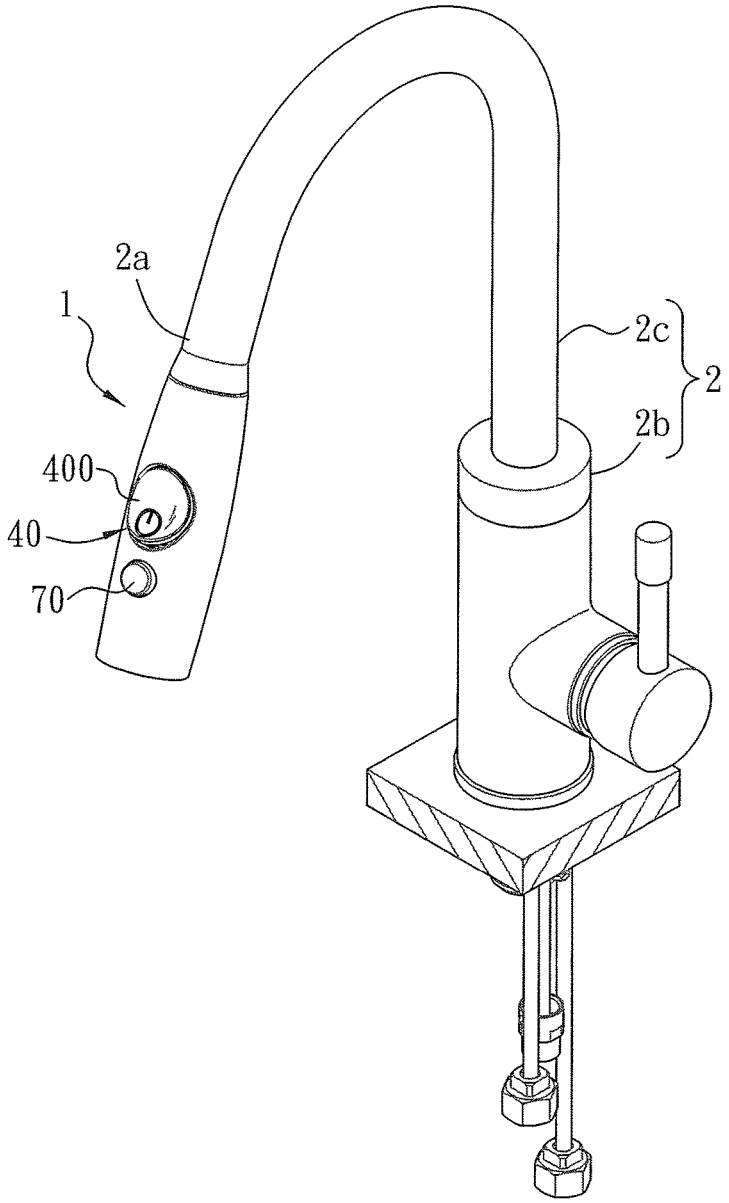
FIG. 1 is a perspective view showing the application of a touch spray head according to a first embodiment of the present invention.
Figure 2:
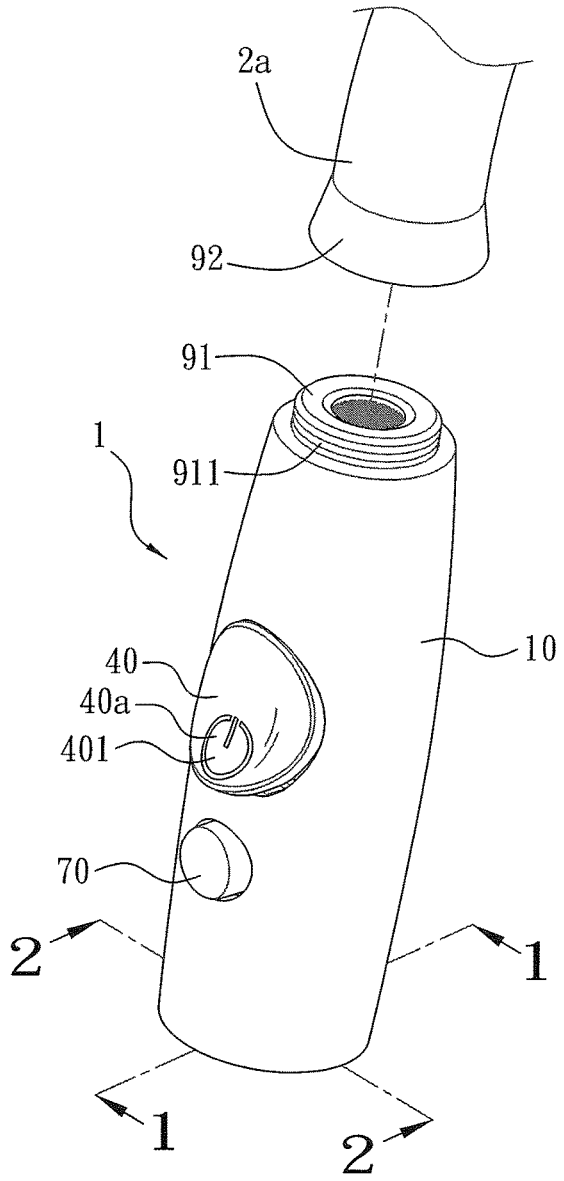
FIG. 2 is a perspective view showing the application of a part of the touch spray head according to the first embodiment of the present invention.

With reference to FIGS. 1 and 2, a touch spray head 1 according to a preferred embodiment of the present invention is mounted on a faucet which is fixed in a kitchen or a bathroom. The touch spray head 1 is removably connected on an outlet 2*a* of a faucet body 2, and the faucet body 2 includes a holder 2*b* and an outflow tube 2*c* extending windingly from a top of the holder 2*b*, wherein the outlet 2*a* defines on a distal end of the outflow tube 2*c*.

The touch spray head 1 includes a casing 10, a fixing cylinder 20, a water valve 30, and a manual operation device 40.

Figure 3:
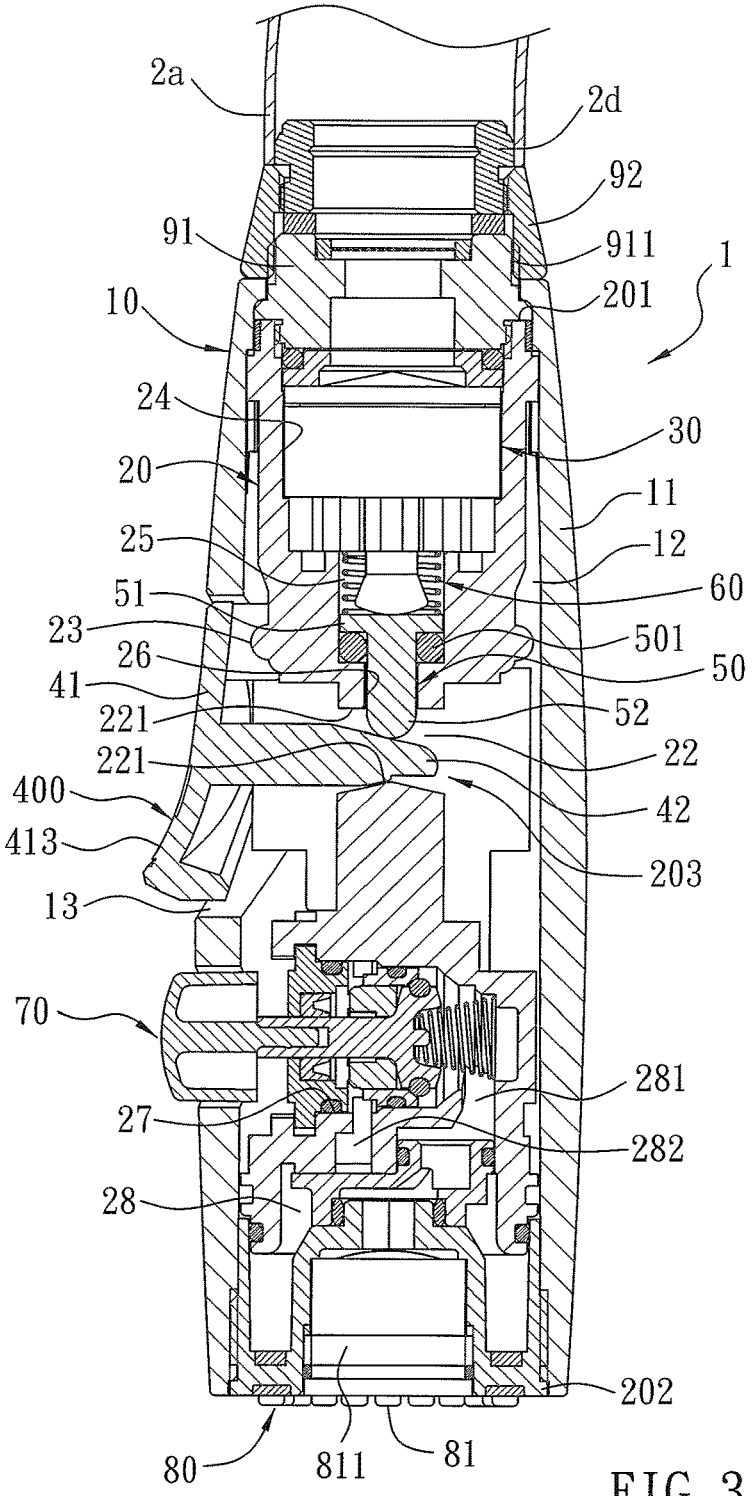
FIG. 3 is a cross sectional view taken along the line 1-1 of FIG. 2.
Figure 4:
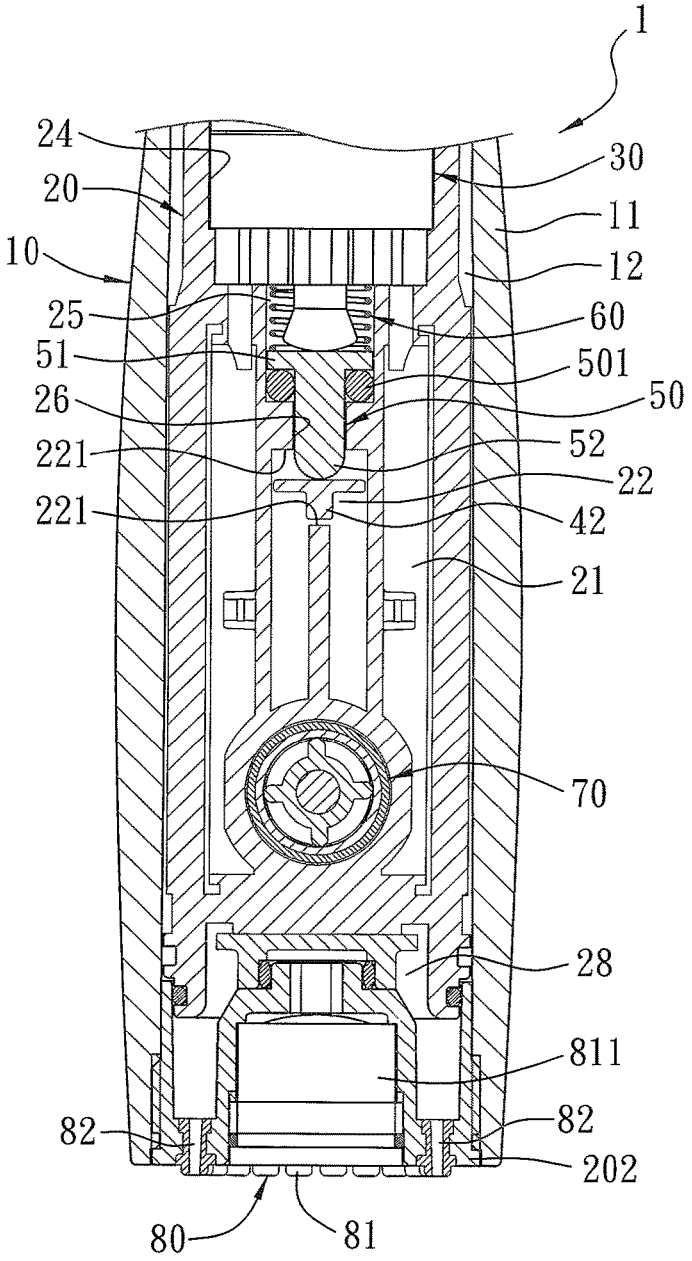
FIG. 4 is a cross sectional view taken along the line 2-2 of a part of FIG. 2.
Figure 5:
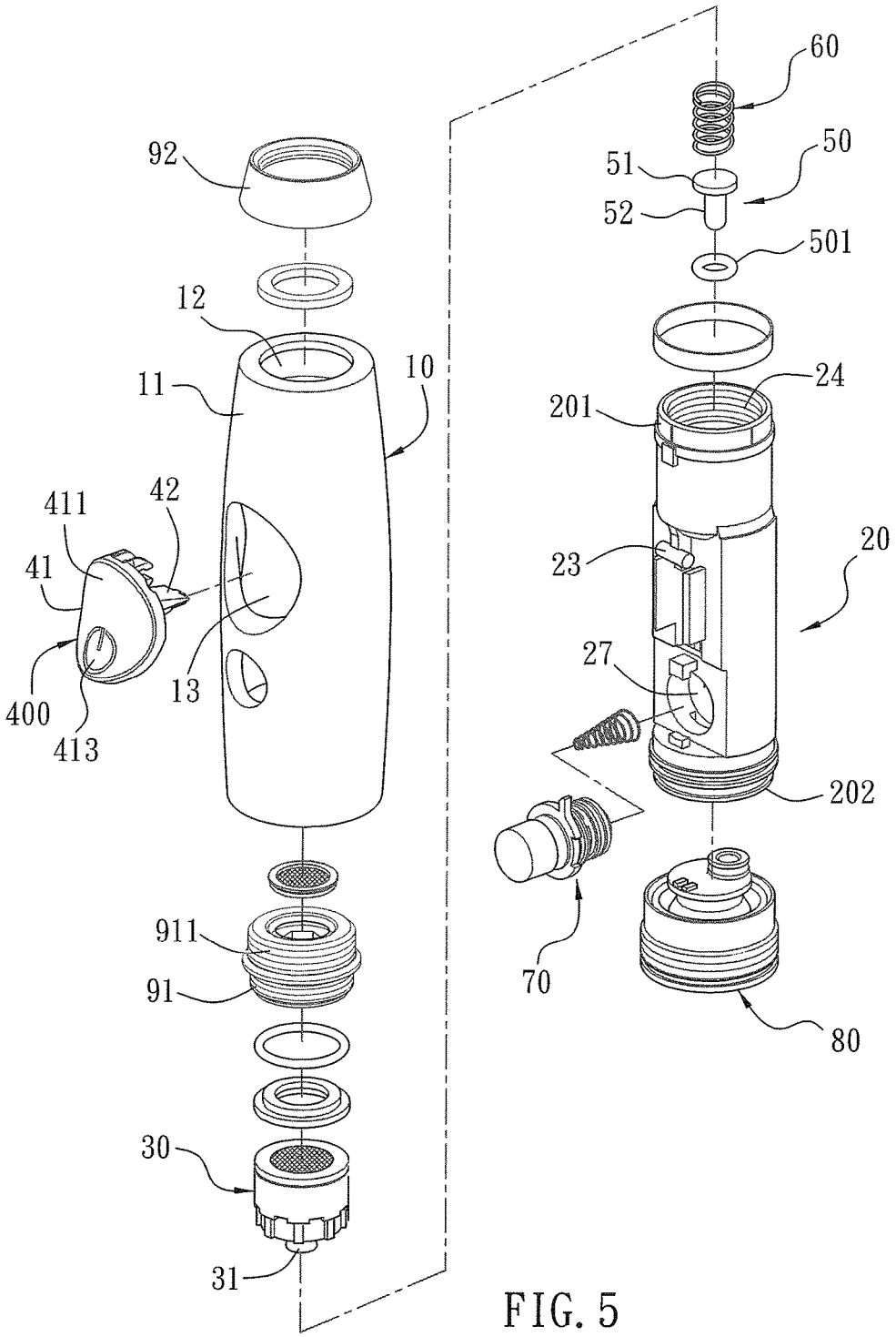
FIG. 5 is a perspective view showing the exploded components of the touch spray head according to the first embodiment of the present invention.

Referring to FIGS. 3-5, the casing 10 includes a surrounding fence 11, an accommodation space 12 defined inside the surrounding fence 11, and a through hole 13 formed on the surrounding fence 11 and communicating with the accommodation space 12.

Figure 6:
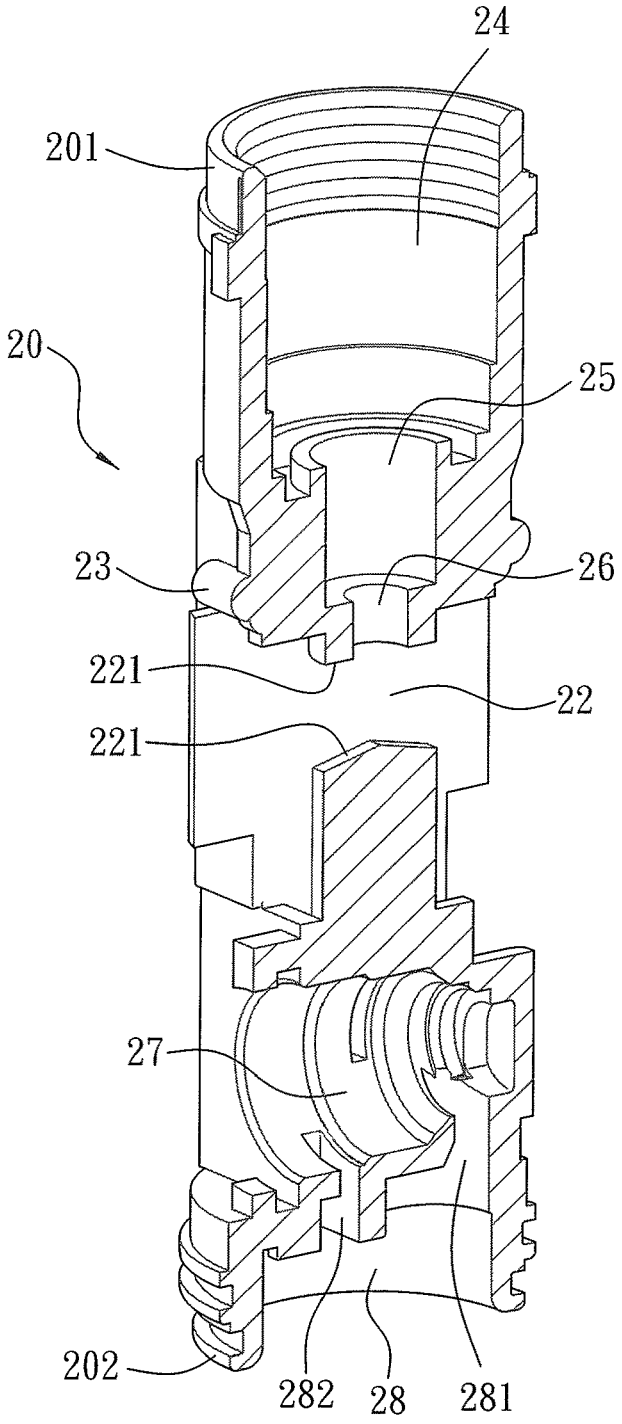
FIG. 6 is a cross-sectional perspective view showing the assembly of a fixing cylinder of the touch spray head according to the first embodiment of the present invention.
Figure 7:
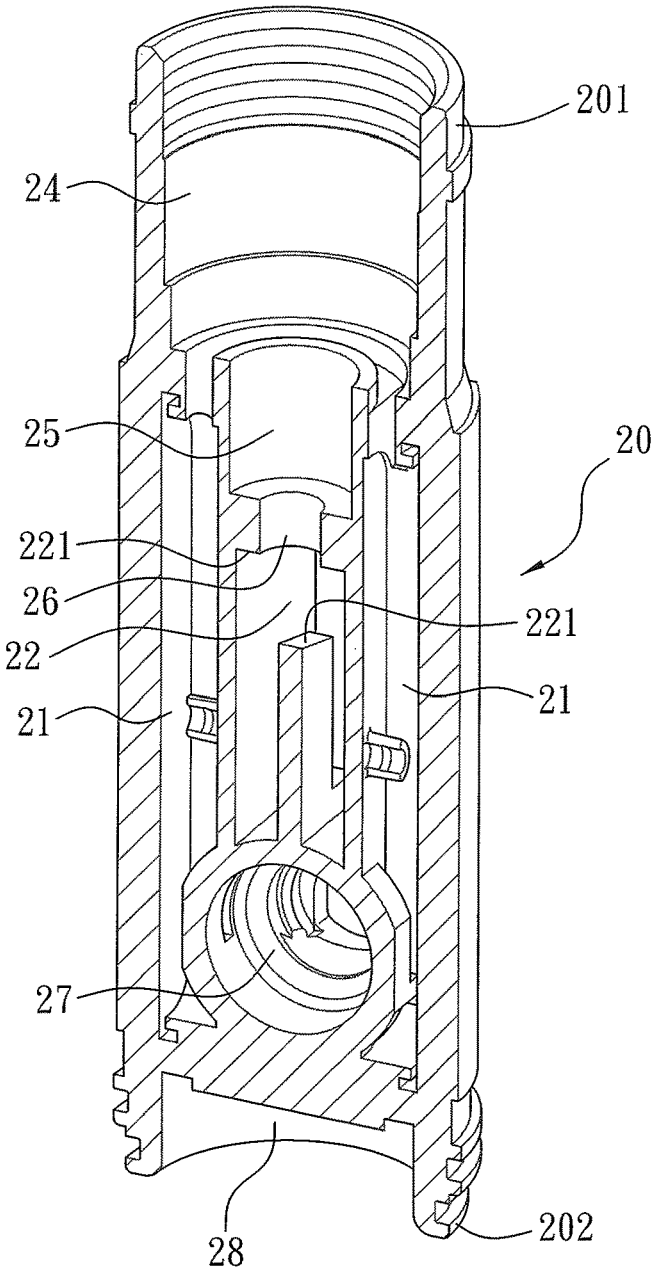
FIG. 7 is another cross-sectional perspective view showing the assembly of the fixing cylinder of the touch spray head according to the first embodiment of the present invention.

As shown in FIGS. 6 and 7, the fixing cylinder 20 is housed in the accommodation space 12 of the casing 10 and includes an inlet segment 201 communicating with the outlet 2*a* of the faucet body 2, an outlet segment 202, at least one first orifice 21 defined between the inlet segment 201 and the outlet segment 202, and a receiving zone 203.

The water valve 30 is accommodated in the fixing cylinder 20 and includes an operation bar 31 touched to movably turn on the water valve 30 so that the water flows into the at least one first orifice 21 of the fixing cylinder 20 from the outlet 2*a* of the faucet body 2.

The manual operation device 40 is housed in the receiving zone 203 of the fixing cylinder 20 and the through hole 13 of the casing 10, and the manual operation device 40 includes a driving portion 40*a* formed in the through hole 13 so as to be driven by user to actuate the operation bar 31 of the water valve 30 to move.

Figure 8:
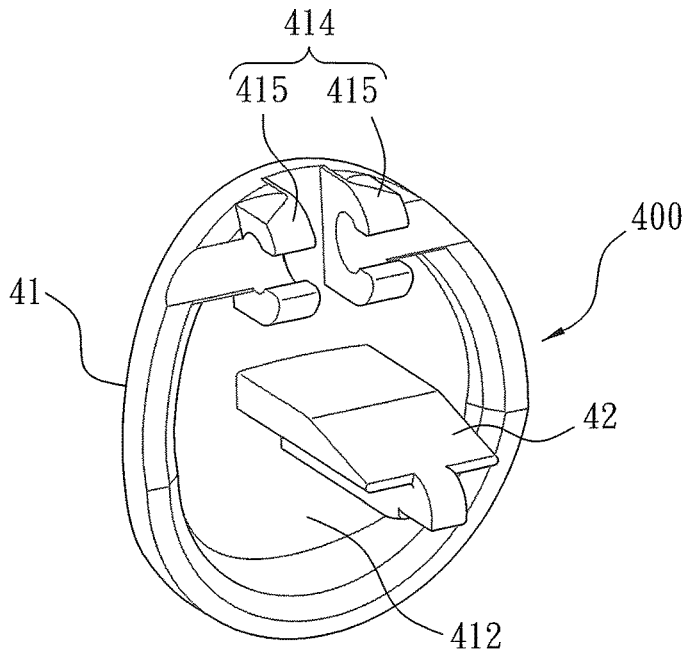
FIG. 8 is a perspective view showing the assembly of a pressing button of the touch spray head according to the first embodiment of the present invention.
Figure 9:
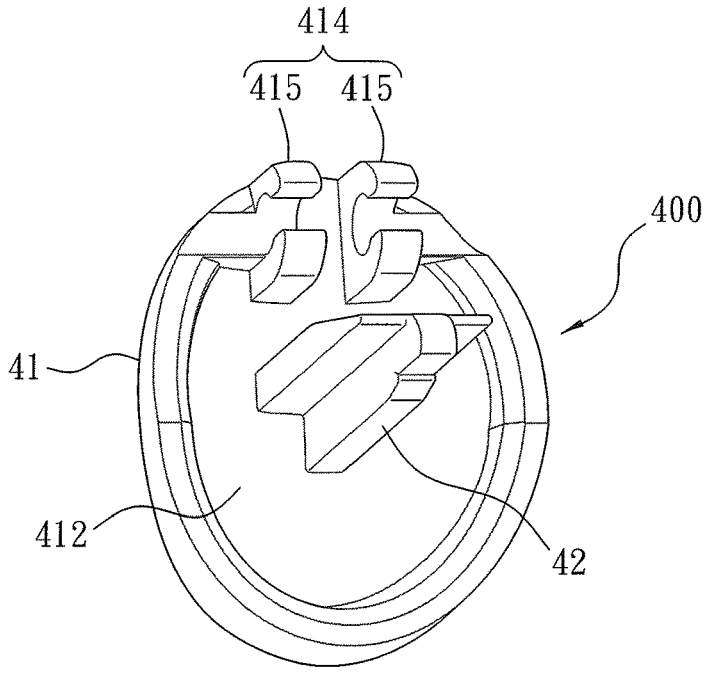
FIG. 9 is another perspective view showing the assembly of the pressing button of the touch spray head according to the first embodiment of the present invention.

In this embodiment, the fixing cylinder 20 further includes a second orifice 22 formed in the receiving zone 203 and includes a first connection portion 23. The manual operation device 40 includes a pressing button 400 which has a force portion 41 and a drive stem 42 extending from the force portion 41. As shown in FIGS. 8 and 9, a part of the drive stem 42 is limited in the second orifice 22 of the fixing cylinder 20; the force portion 41 has an external face 411 and an internal face 412, wherein the external face 411 has an operating zone 413 configured to form the driving portion 40*a*, the internal face 412 has a second connection portion 414 rotatably connected with the first connection portion 23, hence when the operating zone 413 is pressed, the drive stem 42 in the second orifice 22 touches the operation bar 31 of the water valve 30 to move by way of the first connection portion 23 and the second connection portion 414.

The fixing cylinder 20 further includes a receiving cavity 24 located on the inlet segment 201, a groove 25 formed in a bottom of the receiving cavity 24, and a third orifice 26 passing through a bottom of the groove 25, wherein the at least one first orifice 21 communicates with the receiving cavity 24 and the outlet segment 202. The water valve 30 is accommodated in the receiving cavity 24, and the operation bar 31 is housed in the groove 25.

With reference to FIGS. 3-5, the touch spray head 1 further includes a push column 50 extending out of the groove 25 from the third orifice 26 and configured to push the drive stem 42 of the pressing button 400 to actuate the operation bar 31.

In this embodiment, the operating zone 413 of the pressing button 400 is touched by the user via the through hole 13 of the casing 10, as illustrated in FIG. 3. Preferably, a size of the through hole 13 is more than the force portion 41 of the pressing button 400 so that the force portion 41 is accommodated in the through hole 13, and the operating zone 413 of the force portion 41 exposes outside so that the user presses the operating zone 413.

In this embodiment, the first connection portion 23 of the fixing cylinder 20 is at least one rotary shaft; the second connection portion 414 of the pressing button 400 is at least one rotatable tab 415 configured to retain with the at least one rotary shaft. For example, the first connection portion 23 is a rotary shaft, and the second connection portion 414 is two rotatable tabs retained with the rotary shaft.

Alternatively, the first connection portion 23 of the fixing cylinder 20 is at least one rotatable tab, and the second connection portion 414 of the pressing button 400 is at least one rotary shaft retained with the at least one rotatable tab.

The push column 50 includes a fitting portion 51 sliding upward and downward in the groove 25, and the push column 50 includes an extension 52 extending out of the third orifice 26 from the fitting portion 51. The fitting portion 51 is configured to drive the operation bar 31 of the water valve 30. A distal end of the extension 52 is driven by the drive stem 42 of the pressing button 400.

Referring to FIGS. 3-5, the touch spray head 1 further comprises a compression spring 60 accommodated in the groove 25 between the water valve 30 and the fitting portion 51 of the push column 50 so that the push column 50 and the pressing button 400 are pushed by the compressing spring 60 to move back to original positions respectively.

Figure 10:
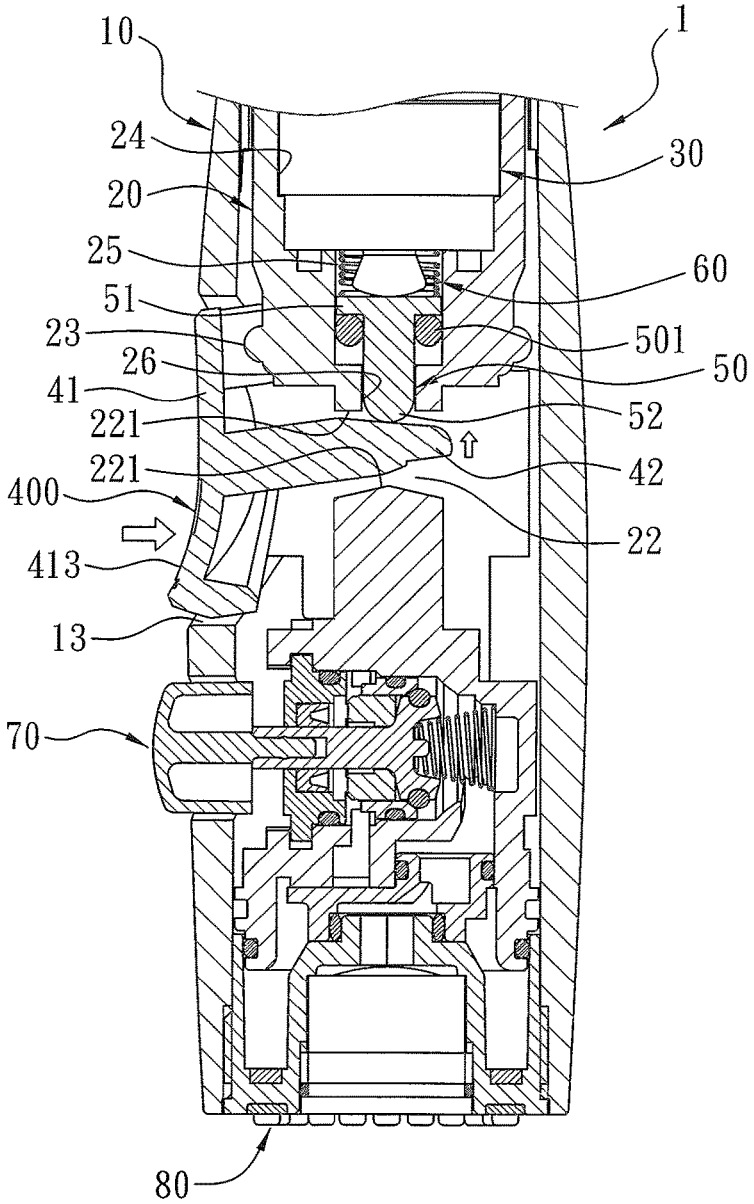
FIG. 10 is a cross sectional view showing the operation of the touch spray head according to the first embodiment of the present invention.

In this embodiment, the second orifice 22 of the fixing cylinder 20 has two opposite limiting fringes 221 defined therein so that when the drive stem 42 of the pressing button 400 is pressed and released, the drive stem 42 moves between the two opposite limiting fringes 221. The second connection portion 414 of the pressing button 400 is opposite to the operating zone 413 of the pressing button 400. As shown in FIG. 3, when the pressing button 400 is not pressed, the operating zone 413 extends out of the through hole 13 of the casing 10 so as to be pressed by the user easily. Preferably, an on/off pattern arranged on the operating zone 413, as illustrated in FIG. 5. When the operating zone 413 of the pressing button 400 is pressed, the pressing button 400 rotates in the through hole 13 so that the drive stem 42 removes from a lower one of the two limiting fringes 221 to swing upward, hence the push column 50 is pushed upwardly by the drive stem 42 so as to drive the operation bar 31 to turn on the water valve 30, thus flowing the water, as illustrated in FIG. 10.

In this embodiment, the extension 52 of the push column 50 has a seal washer 501 fitted thereon and contacting with the groove 25 so as to avoid water leakage out of the third orifice 26 from the groove 25, as illustrated in FIGS. 3 and 4.

The touch spray head 1 further comprises a switch valve assembly 70 arranged on the fixing cylinder 20 and configured to switch to water spraying mode, and the touch spray head 1 comprises a water spray set 80, as shown in FIGS. 3 and 4. The switch valve assembly 70 is pressed so as to guide the water to the water spray set 80 from the at least one first orifice 21, thus producing at least two water spraying modes, such as a central spraying mode and a peripheral spraying mode.

With reference to FIGS. 6 and 7, the fixing cylinder 20 includes a first trench 27 communicating with the at least one first one orifice 21 so as to fix the switch valve assembly 70 in the first trench 27. The fixing cylinder 20 further includes a second trench 28 for accommodating the water spray set 80, wherein the second trench 28 has a central channel 281 and a peripheral channel 282 communicating with the first trench 27. The water spray set 80 includes a first aperture 81 communicating with the central channel 281 so as to spray the water out of the first aperture 81 in the central spraying mode, and the water spray set 80 includes multiple second apertures 82 communicating with the peripheral channel 282 so as to spray the water from the multiple second apertures 82 in the peripheral spraying mode. The first aperture 81 includes a bubble generator 811 so as to produce bubble water.

The fixing cylinder 20 matches with a water sprayer so as to spray the water from the at least one first orifice 21 in the water spraying mode.

Referring to FIGS. 3-5, the touch spray head 1 further comprises an inflow connector 91 screwed in a top of the receiving cavity 24, and the inflow connector 91 has a threaded connecting portion 911 extending out of a top of the casing 10, a screw sleeve 92 formed on the outlet 2*a* of the faucet body 2 and screwing with the threaded connecting portion 911. The outlet 2*a* has a coupling seat 2*d* welded therein, wherein the coupling seat 2*d* has outer threads formed thereon so as to screw with inner threads of the screw sleeve 92.

With reference to FIGS. 11-14, a difference of a touch spray head 1*a* of a second embodiment from that of the first embodiment comprises:

a housing portion 13*a* formed on the surrounding fence 11 of the casing 10 and communicating with the accommodation space 12, and the housing portion 13*a* has the through hole 13.

Figure 16:
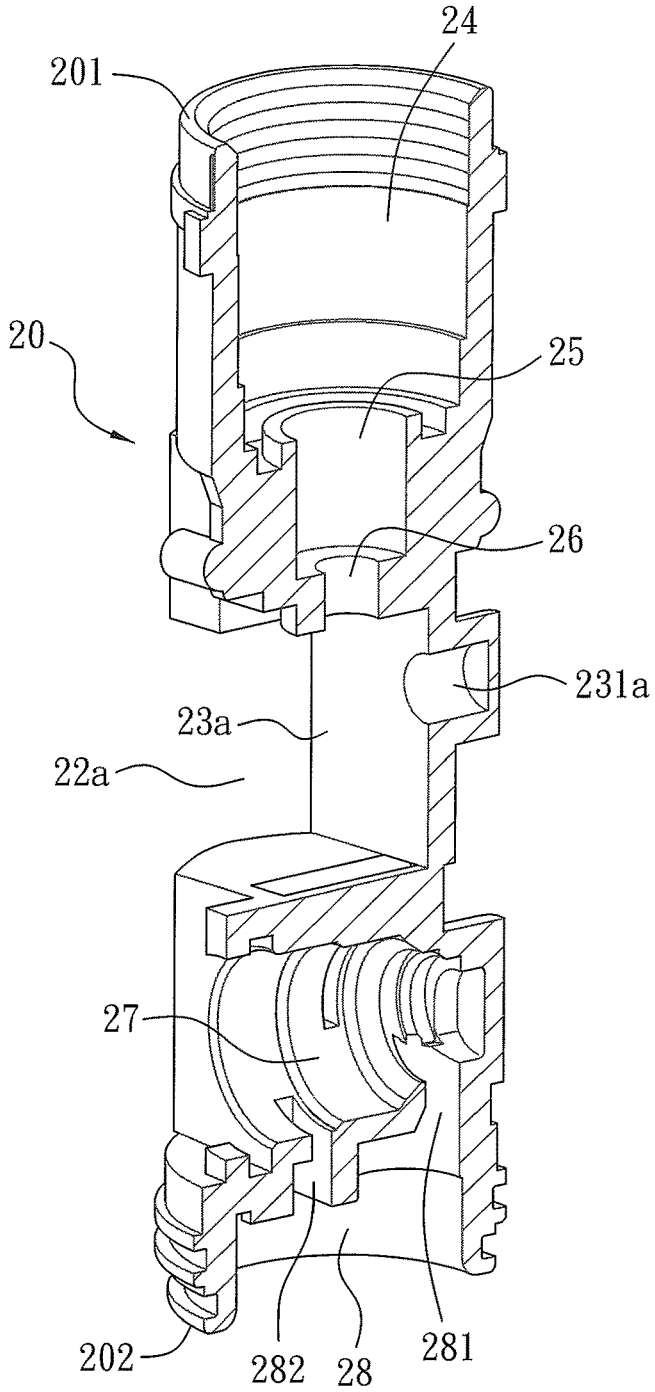
FIG. 16 is a cross-sectional perspective view showing the assembly of a fixing cylinder of the touch spray head according to the second embodiment of the present invention.
Figure 17:
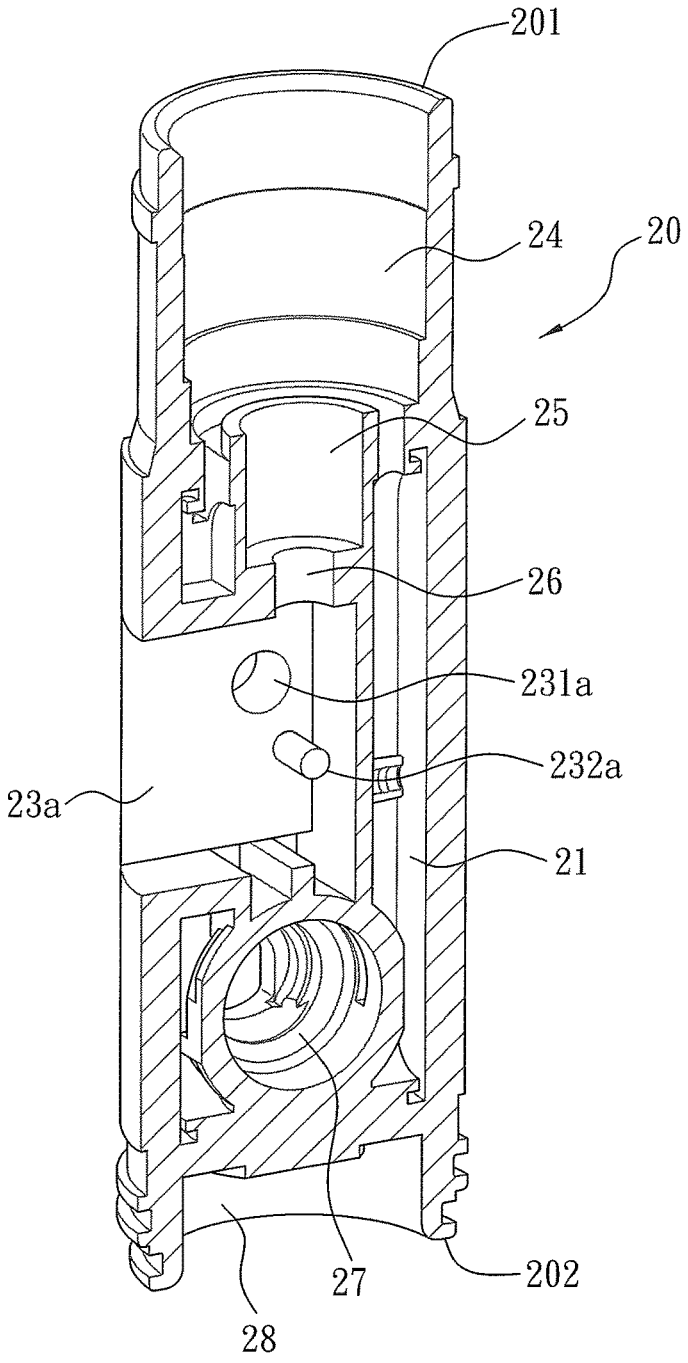
FIG. 17 is another cross-sectional perspective view showing the assembly of the fixing cylinder of the touch spray head according to the second embodiment of the present invention.

Referring to FIGS. 16 and 17, the receiving zone 203 of the fixing cylinder 20 has a first notch 22*a* formed therein; a peripheral fence 23*a* of the first notch 22*a* has a connection portion 231*a* and an affix portion 232*a*. In this embodiment, the connection portion 231*a* is a connection hole.

Figure 18:
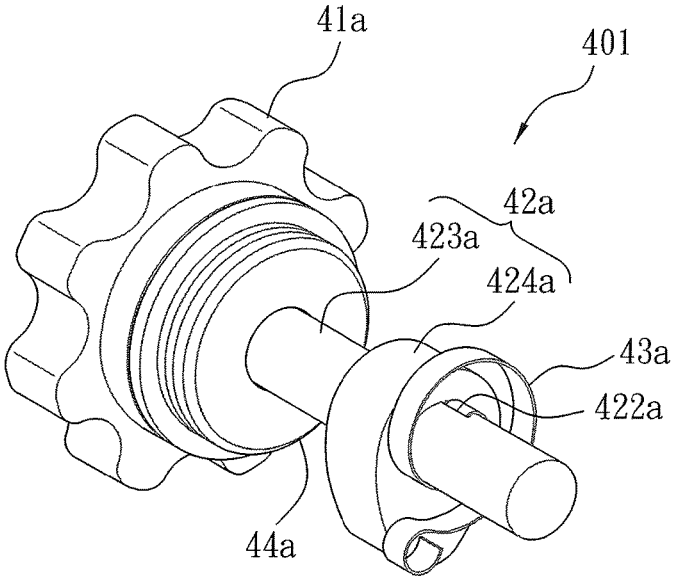
FIG. 18 is a perspective view showing the assembly of a rotation device of the touch spray head according to the second embodiment of the present invention.
Figure 19:
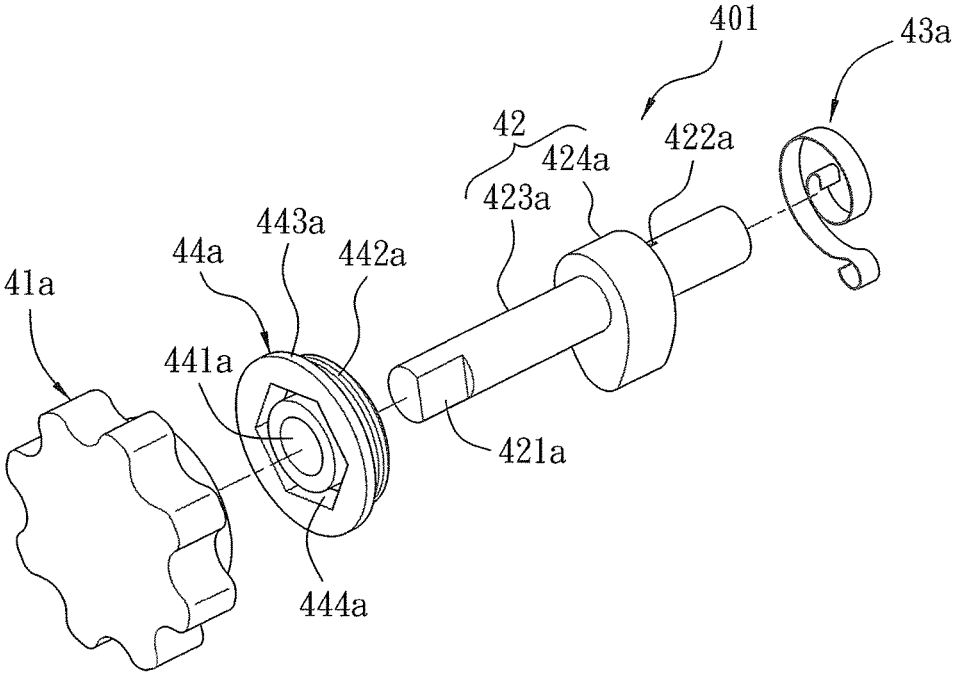
FIG. 19 is a perspective view showing the exploded components of the rotation device of the touch spray head according to the second embodiment of the present invention.
Figure 20:
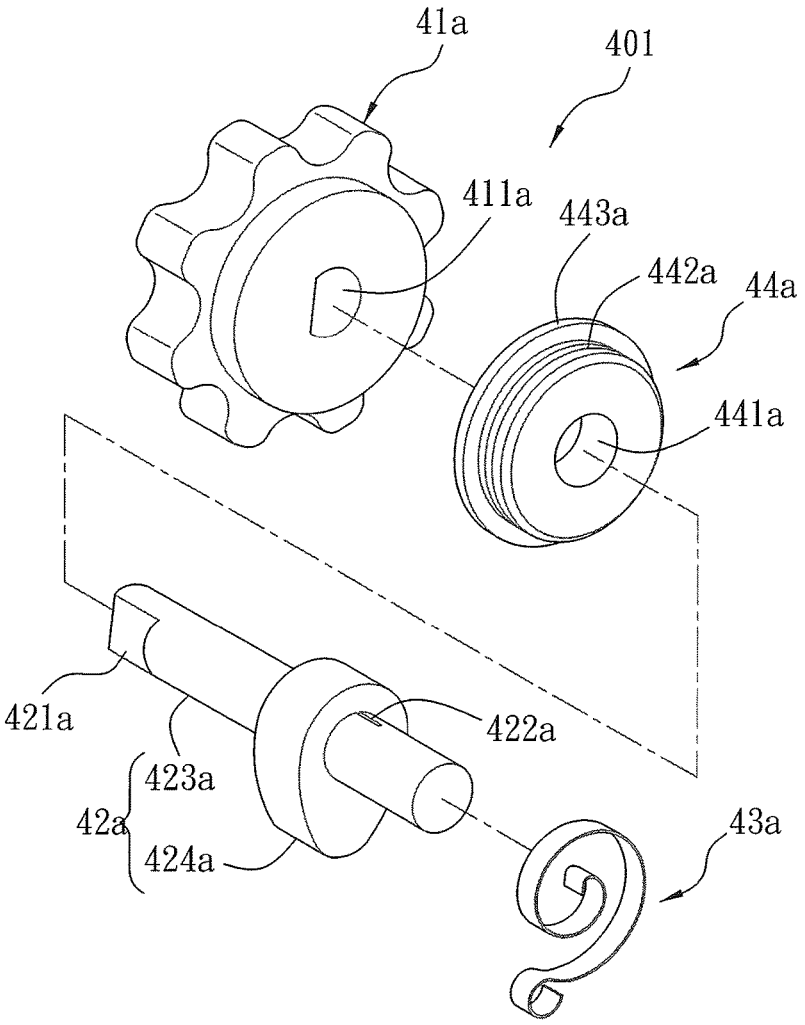
FIG. 20 is another perspective view showing the exploded components of the rotation device of the touch spray head according to the second embodiment of the present invention.
Figure 21:
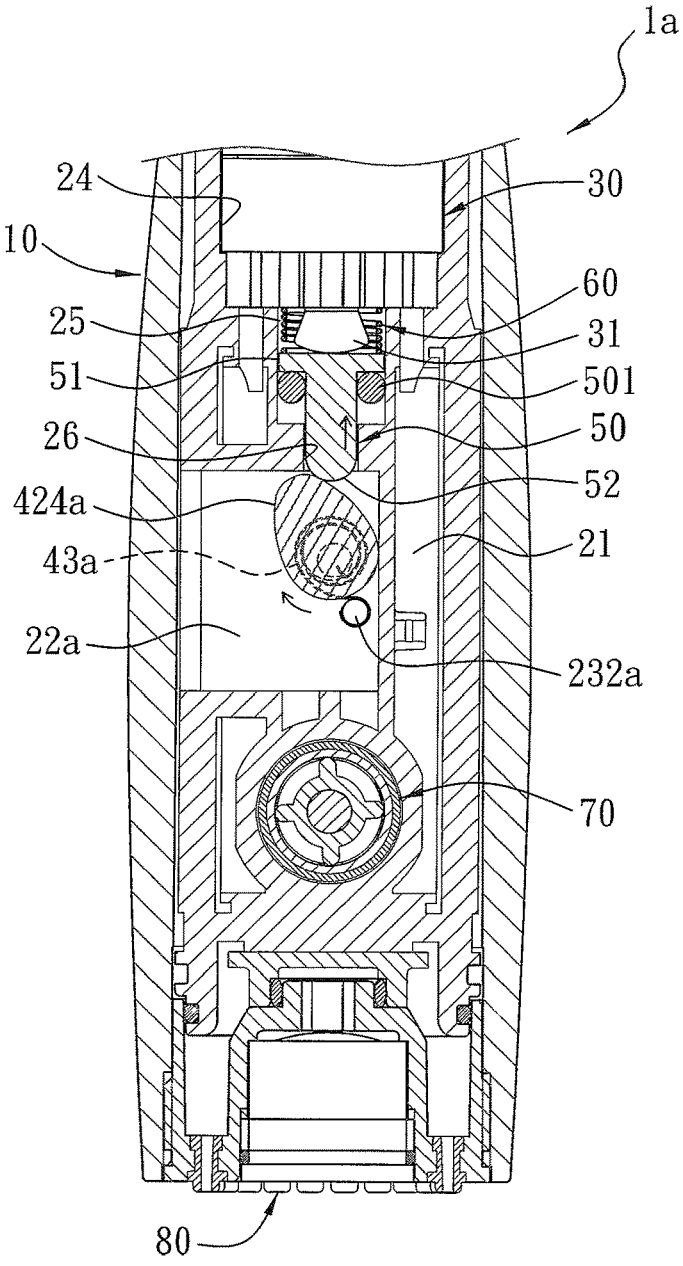
FIG. 21 is a cross sectional view showing the operation of the rotation device of the touch spray head according to the second embodiment of the present invention.
Figure 22:
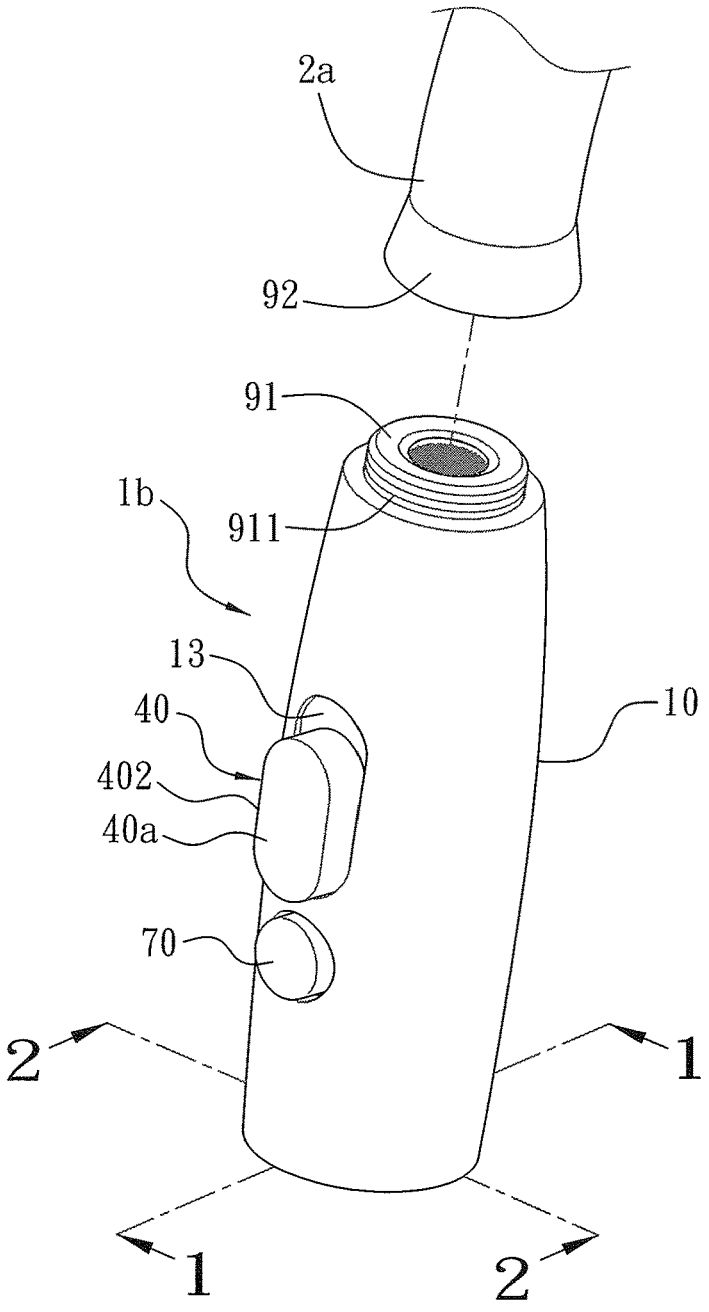
FIG. 22 is a perspective view showing the application of a part of the touch spray head according to a third embodiment of the present invention.

Referring to FIGS. 18-20, the manual operation device 40 is a rotation device 401 housed in the housing portion 13*a* of the casing 10, and the rotation device 40 includes a rotatable knob 41*a* rotated by the user and a drive member 42*a*; a part of the drive member 42*a* is accommodated in the first notch 22*a* of the fixing cylinder 20; the drive member 42*a* has a rotary shaft 423*a* and a cam 424*a* located on the rotary shaft 423*a*, wherein a first end of the rotary shaft 423*a* couples with the rotatable knob 41*a*, and a second end of the rotary shaft 423*a* rotatably connects with the connection portion 231*a* of the fixing cylinder 20. The rotation device 40 further includes a coil spring 43*a*, a first end of which connects with the drive member 42*a*, and a second end of the coil spring 43*a* couples with the affix portion 232*a* of the fixing cylinder 20. The rotatable knob 41*a* is rotated by the user to drive the drive member 42*a* to rotate so that the cam 424*a* of the drive member 42*a* actuates the operation bar 31 of the water valve 30 to move, as shown in FIG. 21, and the coil spring 43*a* is tightened, hence after the cam 424*a* and rotatable knob 41*a* are released, the coil spring 43*a* returns to an original position.

In addition, the cam 424*a* of the rotation device 401 actuates the operation bar 31 via the push column 50.

Figure 12:
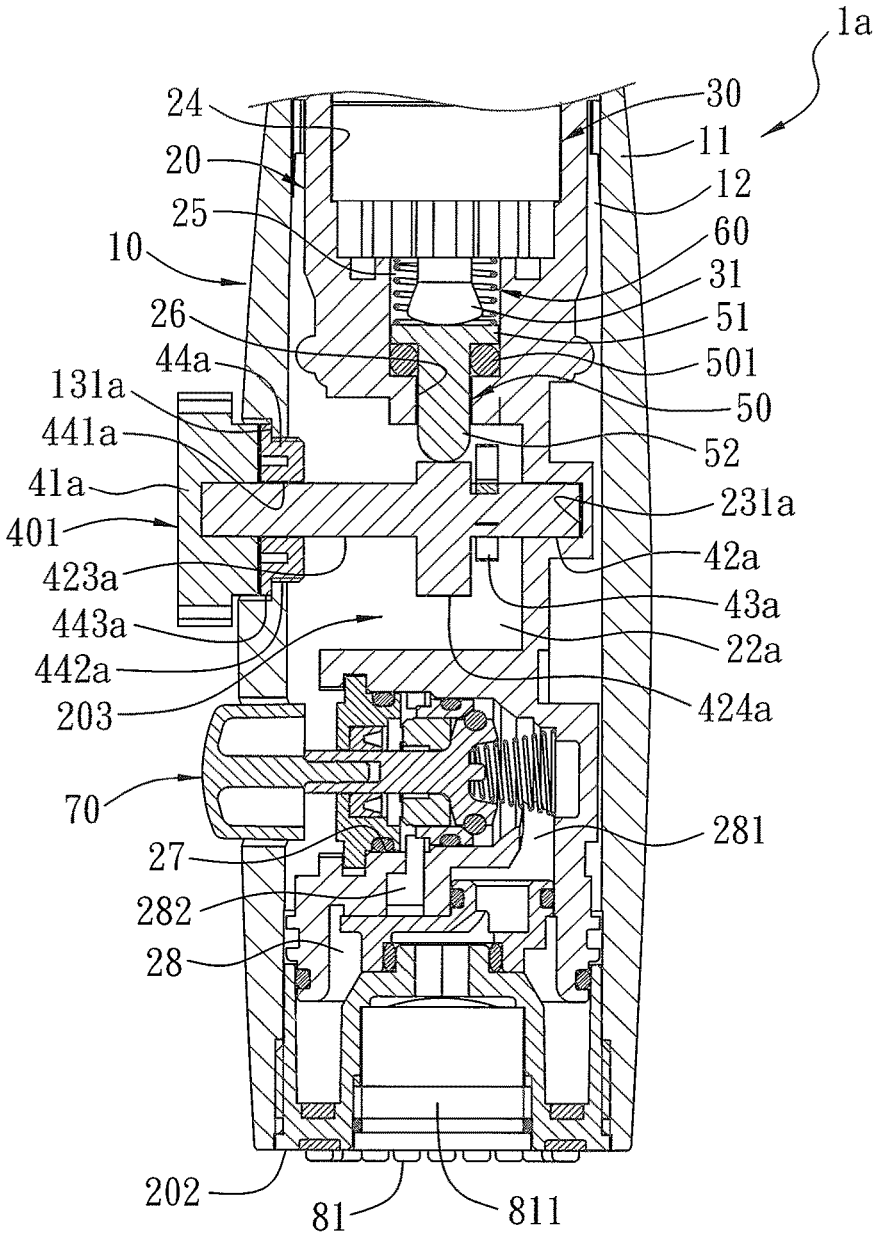
FIG. 12 is a cross sectional view taken along the line 1-1 of a part of FIG. 11.
Figure 15:
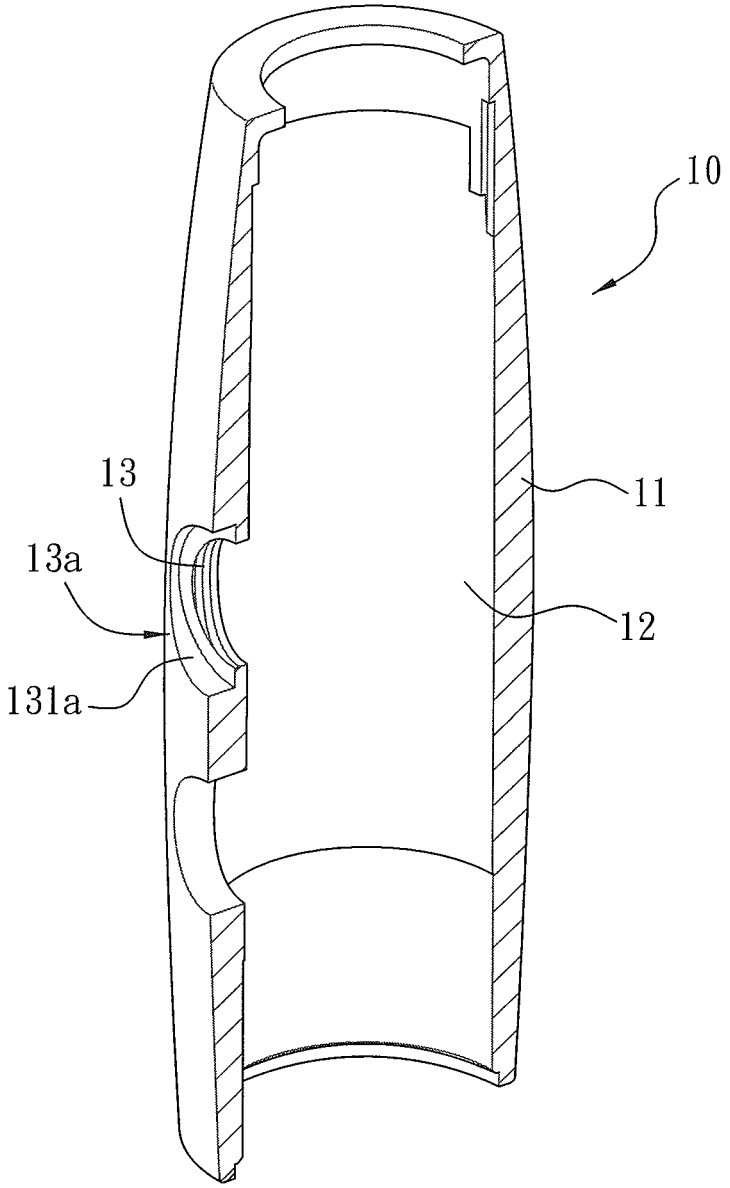
FIG. 15 is a cross-sectional perspective view showing the assembly of a casing of the touch spray head according to the second embodiment of the present invention.

With reference to FIG. 15, the housing portion 13*a* of the casing 10 has a recess 131*a* and has the through hole 13 formed in a bottom of the recess 131*a*, wherein the through hole 13 is a screwing hole communicating with the accommodation space 12 of the casing 10. Referring to FIGS. 18-20, the rotation device 401 further includes a holding seat 44*a* screwing with the screwing hole 13, as shown in FIG. 12, and the holding seat 44 has a coupling opening 441*a* so that the first end of the rotary shaft 423*a* rotatably couples with the rotatable knob 41*a* via the coupling opening 441*a*.

The holding seat 44*a* has a first threaded portion 442*a* arranged on an outer wall thereof and a defining fence 443*a* extending outward from the first threaded portion 442*a*, hence the first threaded portion 442*a* screws with the screwing hole 13, and the defining fence 443*a* abuts against the bottom of the recess 131*a*. The holding seat 44*a* has a first non-circular slot 444*a* defined on an outer edge thereof, and the first non-circular slot 444*a* is hexagonal so that a rotation tool retains in the first non-circular slot 444*a* and screws the holding seat 44*a* with the screwing hole 13.

The rotatable knob 41*a* has a second non-circular slot 411*a* formed in an inner wall thereof, and the second non-circular slot 411*a* is semicircular or is in a D shape. The rotary shaft 423*a* of the drive member 42*a* has a non-circular connector 421*a* formed on an outer end thereof so that the non-circular connector 421*a* retains in the second non-circular slot 411*a* to connect the rotatable knob 41*a* and the drive member 42*a* together.

In this embodiment, the cam 424*a* of the drive member 42*a* is one-piece formed on the rotary shaft 423*a*. In another embodiment, the cam 424*a* and the rotary shaft 423*a* are connected together in a welding manner or in a fitting manner.

Figure 11:
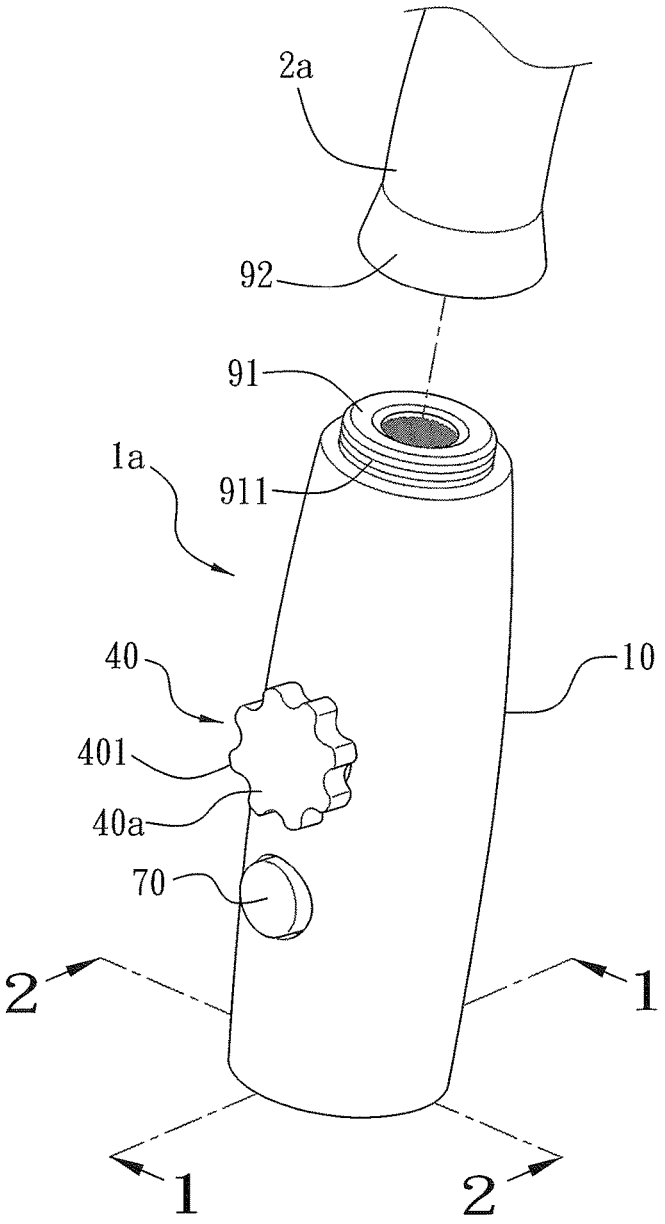
FIG. 11 is a perspective view showing the application of a touch spray head according to a second embodiment of the present invention.

As illustrated in FIG. 20, the drive member 42*a* has a second notch 422*a* defined on one end thereof adjacent to the cam 424*a*. With reference to FIGS. 17 and 18, a first fitting portion 232*a* of the fixing cylinder 20 is a post so that the coil spring 43*a* fits on the rotary shaft 423*a* and a first end of the coil spring 43*a* fixes in the second notch 422*a*, a second end of the coil spring 43*a* fits on the first fitting portion 232*a*. Referring to FIG. 11, when the drive member 42*a* revolves clockwise, the coil spring 43*a* twists tightly and forces the drive member 42*a*, hence the rotatable knob 41*a* and the drive member 42*a* move back to original positions respectively. In other words, the cam 424*ab* removes from the push column 50.

In this embodiment, a distal end of the extension 52 of the push column 50 is driven by the cam 424*a* of the rotation device 401.

Figure 13:
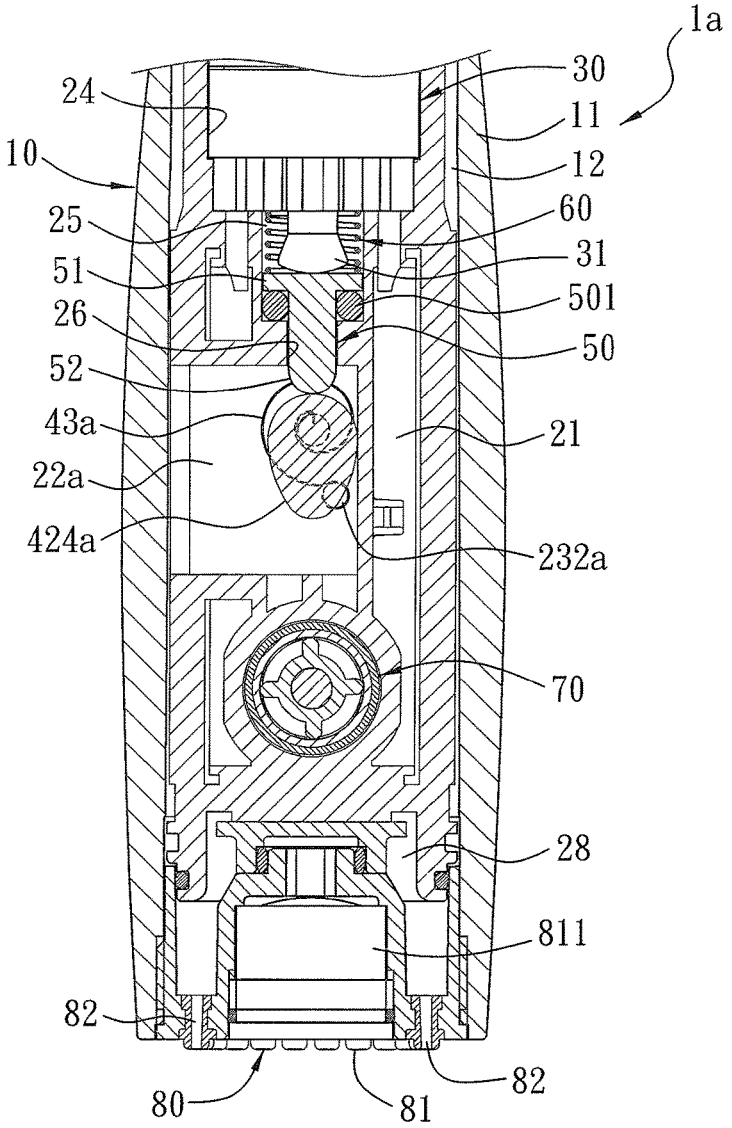
FIG. 13 is a cross sectional view taken along the line 2-2 of a part of FIG. 11.
Figure 14:
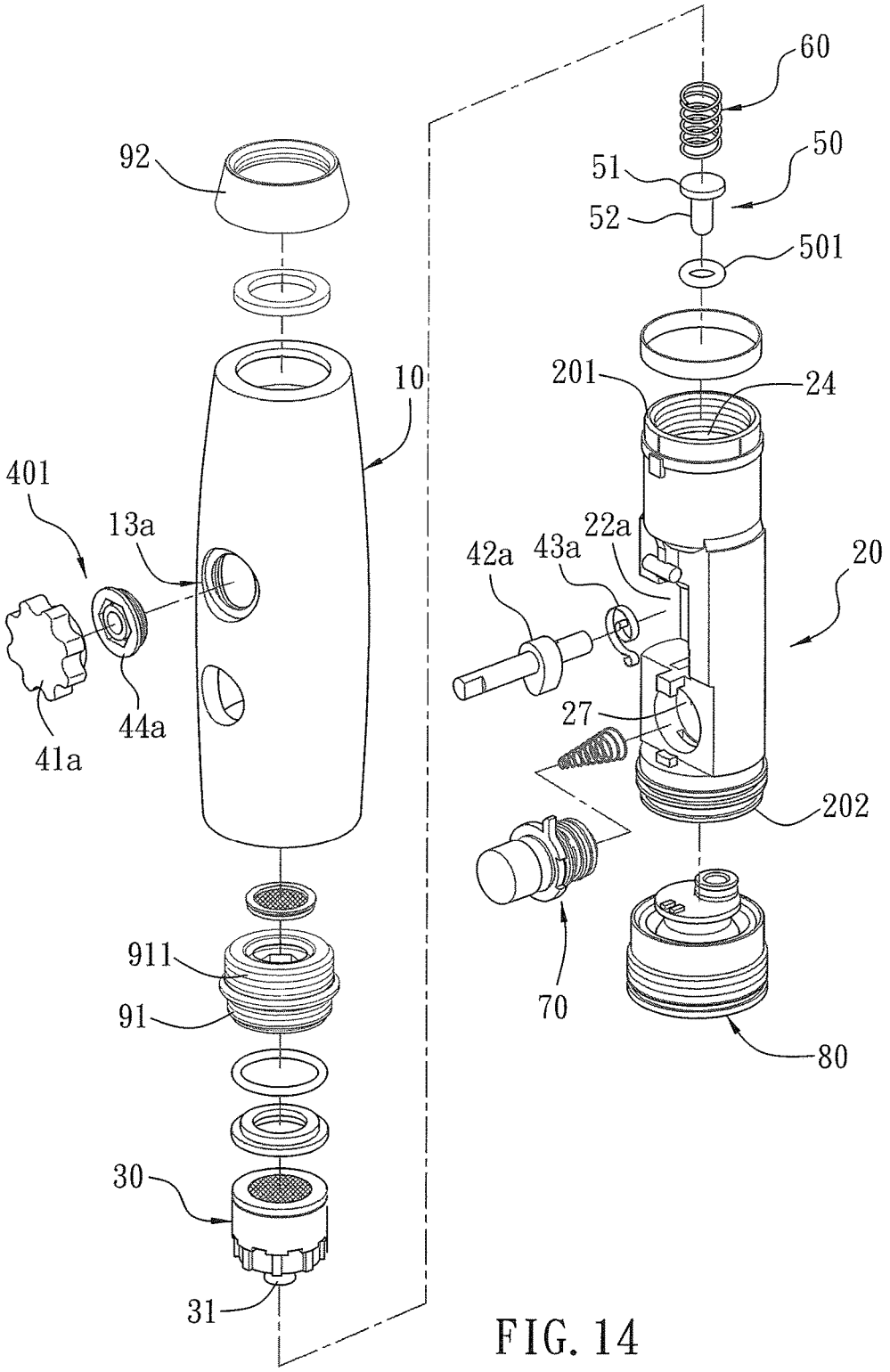
FIG. 14 is a perspective view showing the exploded components of the touch spray head according to the second embodiment of the present invention.

As illustrated in FIGS. 12-14, the touch spray head 1 further comprises a compression spring 60 configured to push the push column 50 to move back to an original position, after releasing the rotation device 401. After the rotation device 401 is released, the rotatable knob 41*a* and the drive member 42*a* are pushed by the coil spring 43*a* to move back to the original positions individually, hence the cam 424*a* removes from the extension 52 of the push column 50, and the push column 50 is pushed by the compression spring 60 to downward moves back to an original position so that the extension 52 moves back to an original position.

With reference to FIGS. 22-25, a difference of a touch spray head 1*b* of a third embodiment from that of the first embodiment comprises:

the surrounding fence 11 of the casing 10 having a positioning portion 13*b* formed thereon, wherein the positioning portion 13*b* has the through hole 13 communicating with the accommodation space 12.

Figure 26:
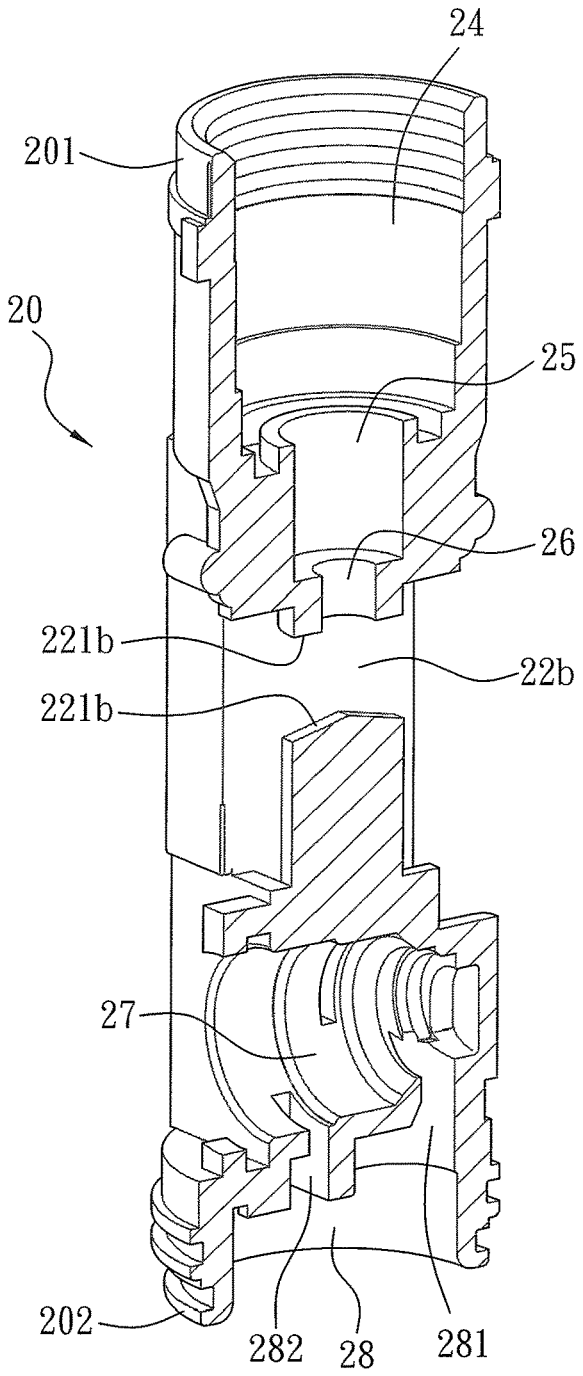
FIG. 26 is a cross-sectional perspective view showing the assembly of a fixing cylinder of the touch spray head according to the third embodiment of the present invention.
Figure 27:
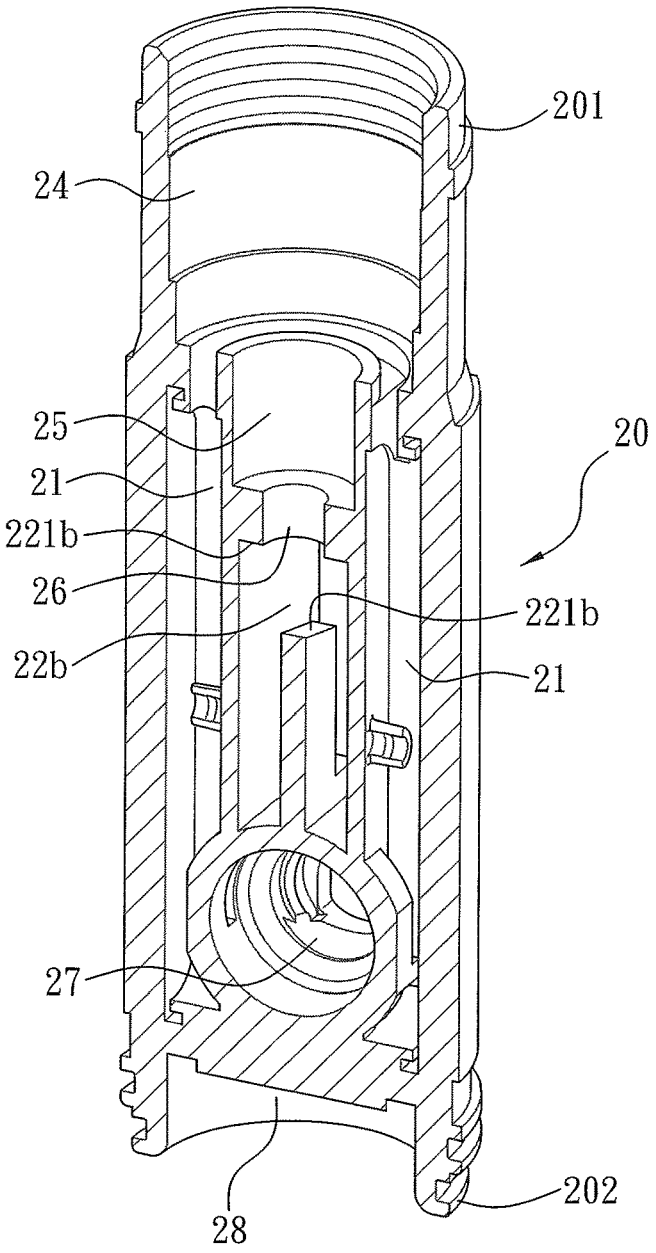
FIG. 27 is a cross-sectional perspective view showing the assembly of the fixing cylinder of the touch spray head according to the third embodiment of the present invention.

Referring to FIGS. 26-27, the fixing cylinder 20 further includes a second orifice 22*b* formed in the receiving zone 203.

The manual operation device 40 is a pushing button 402 sliding within a predetermined distance on the positioning portion 13*b*, and the pushing button 402 includes a movable portion 41*b* and a drive stem 42*b* extending from the movable portion 41*b*; a part of the drive stem 42*b* is limited in the second orifice 22*b* of the fixing cylinder 20, and the drive stem 42*b* is pushed to move on the movable portion 41*b* of the pushing button 402 along the positioning portion 13*b* so as to drive the operation bar 31 of the water valve 30 to move.

In addition, the drive stem 42*b* of the pushing button 402 actuates the operation bar 31 via the push column 50.

Figure 28:
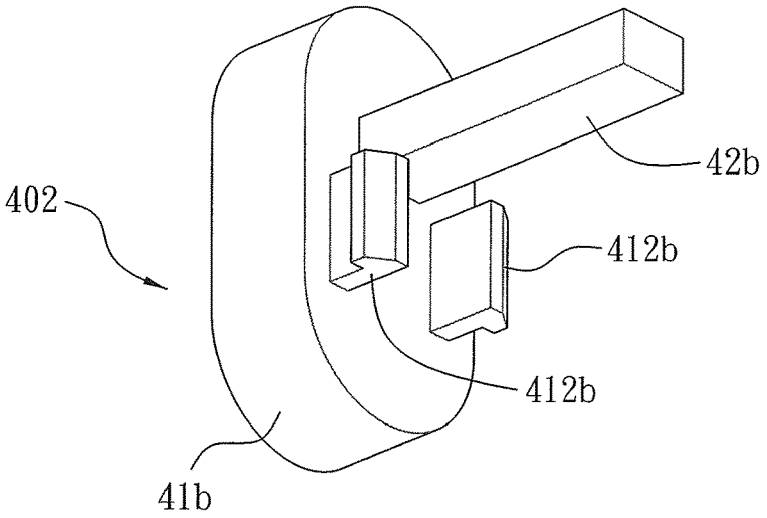
FIG. 28 is a perspective view showing the assembly of a pushing button of the touch spray head according to the third embodiment of the present invention.
Figure 29:
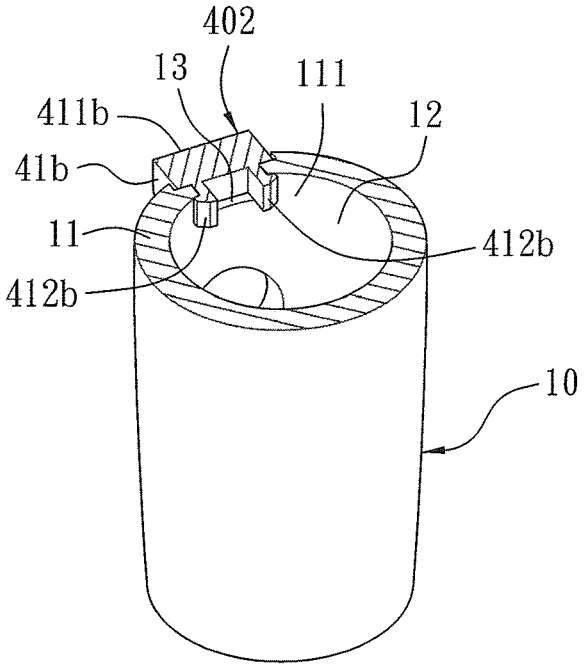
FIG. 29 is a cross-sectional perspective view showing the assembly of the pushing button and a casing of the touch spray head according to the third embodiment of the present invention.
Figure 30:
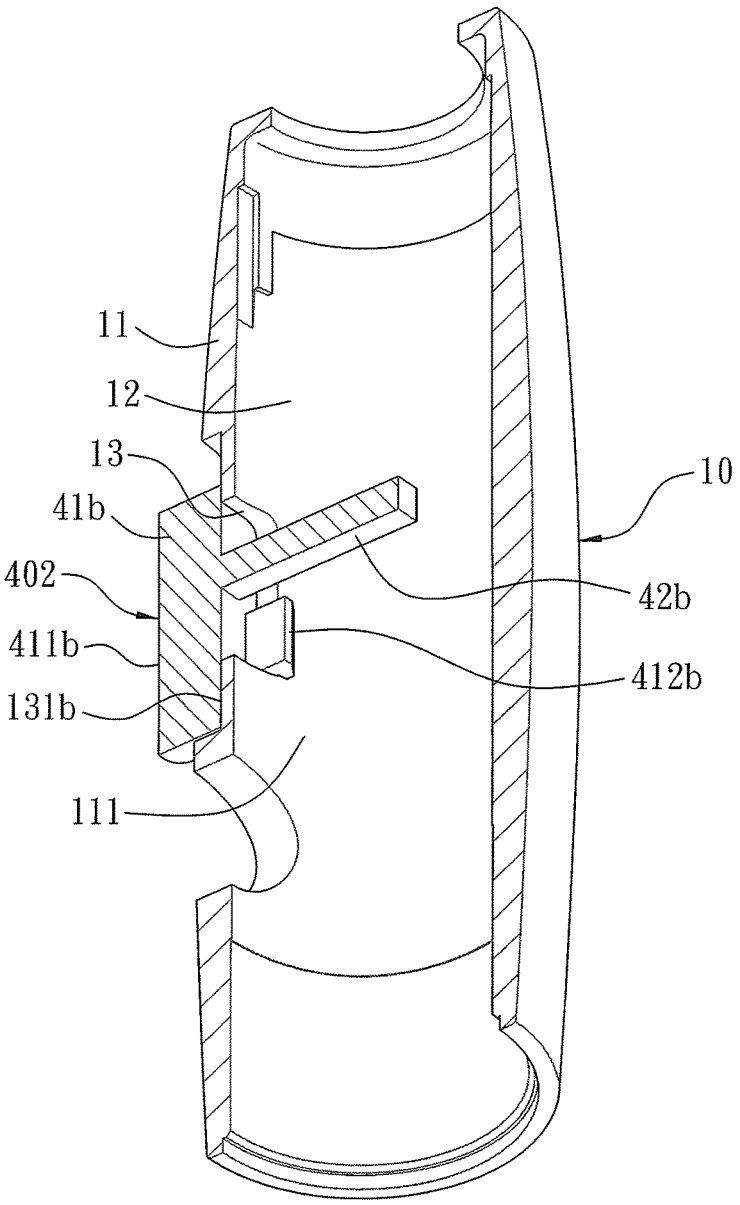
FIG. 30 is another cross-sectional perspective view showing the assembly of the pushing button and a casing of the touch spray head according to the third embodiment of the present invention.

As shown in FIGS. 28-30, the positioning portion 13*b* of the casing 10 has a first trench 131*b* in which the movable portion 41*b* of the pushing button 402 slidably retains and moves. The movable portion 41*b* has an external face 411*b* configured to form the driving portion 40*a*, and the movable portion 41*b* has two flexible hooks 412*b* extending into the casing 10 from the external face 411*b*, wherein the two flexible hooks 412 respectively hook with two opposite ends of an internal fence 111 of the casing 10 via the through hole 13 of the casing 10.

The pushing button 402 is pushed upwardly by the user along the fixing cylinder 20.

In this embodiment, a distal end of the extension 52 of the push column 50 is driven by the drive stem 42*b* of the pushing button 402.

Figure 23:
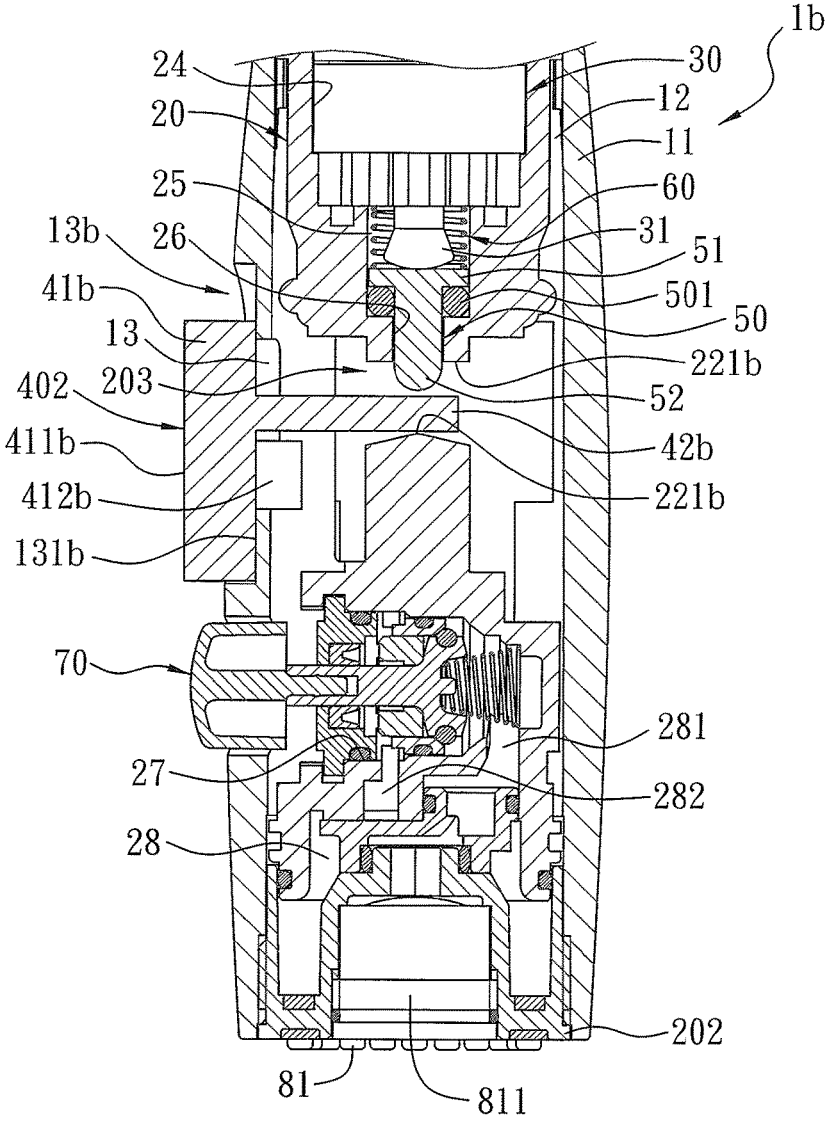
FIG. 23 is a cross sectional view taken along the line 1-1 of a part of FIG. 22.
Figure 24:
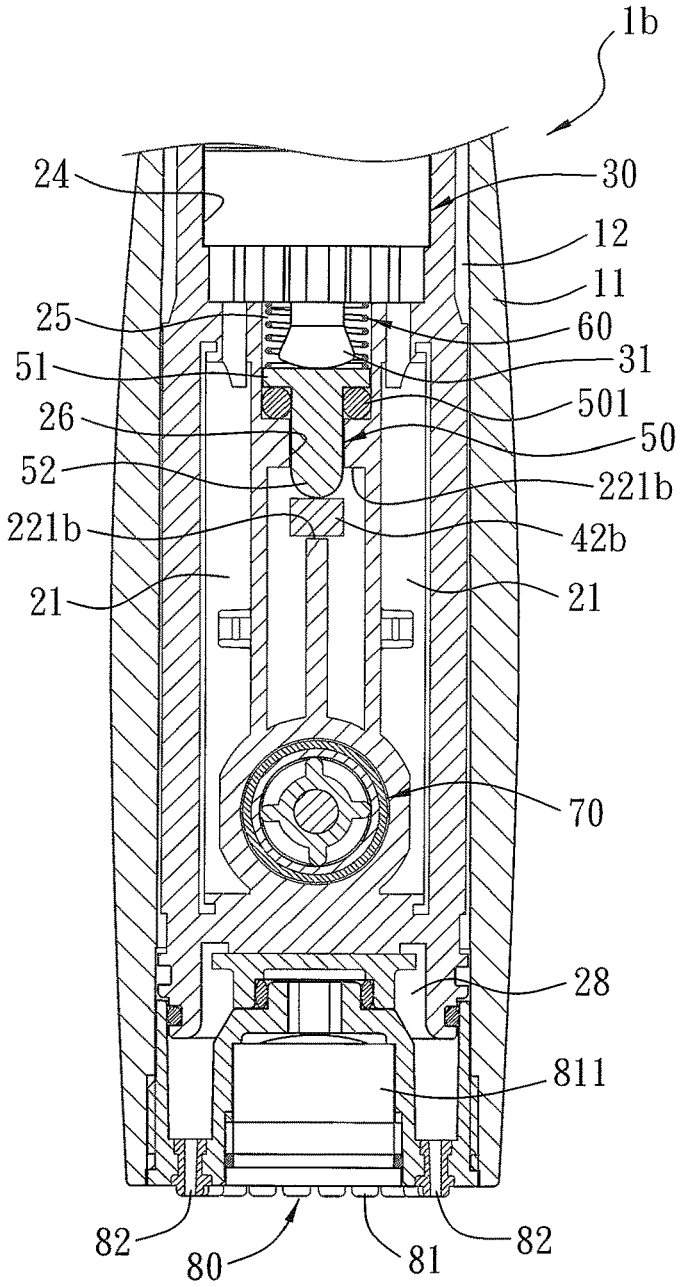
FIG. 24 is a partial cross-sectional view taken along the line 2-2 of a part of FIG. 22.
Figure 25:
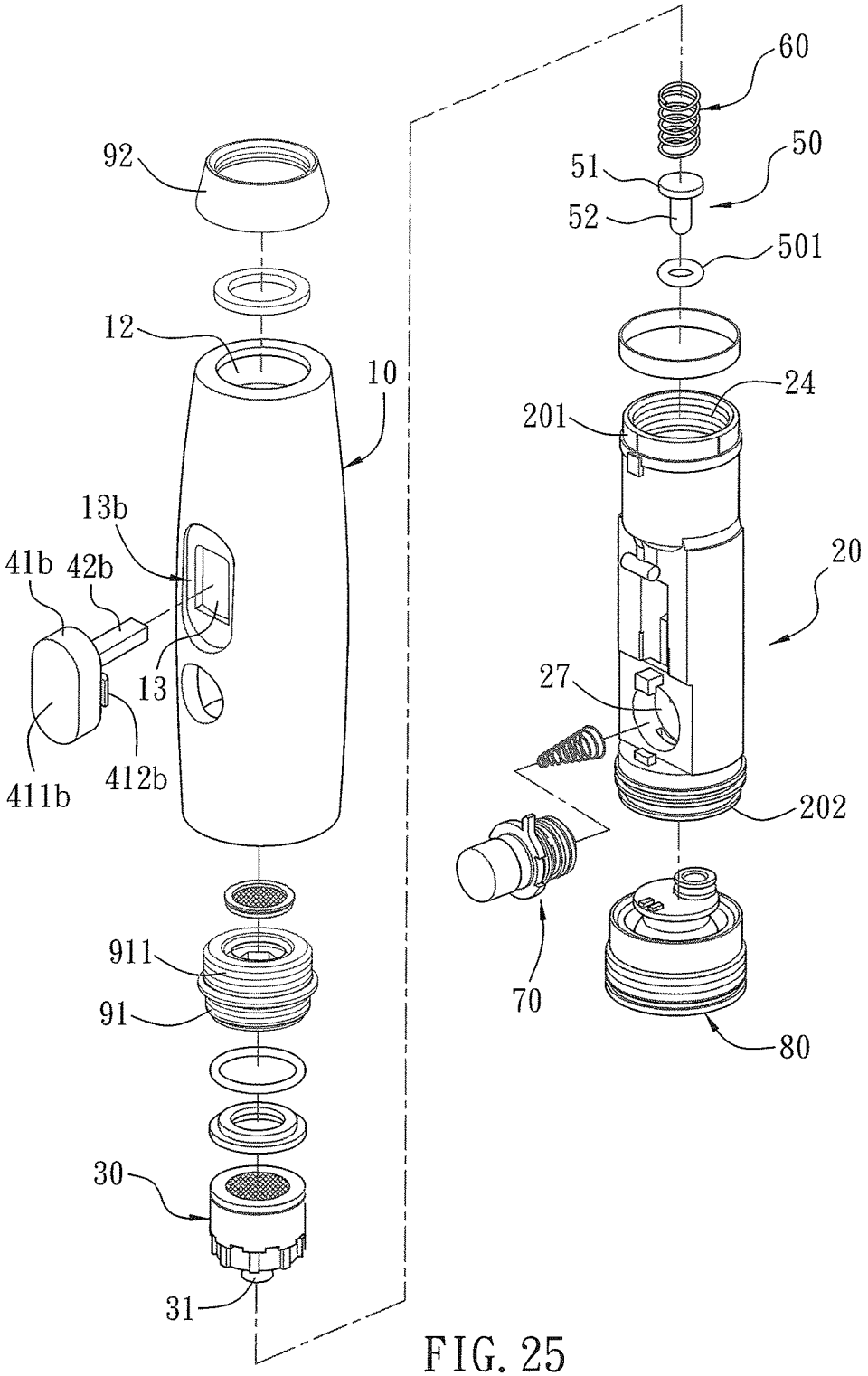
FIG. 25 is a perspective view showing the exploded components of the touch spray head according to the third embodiment of the present invention.

Referring to FIGS. 23-25, the touch spray head 1 further comprises a compression spring 60 configured to push the push column 50 and the pushing button 402 to move back to original positions respectively after releasing the pushing button 402. In other words, an elasticity of the compression spring 60 acts on the push column 50 so that the push column 50 downward pushes against the drive stem 42*b* of the pushing button 402, hence the pushing button 402 moves back to an original position.

Figure 31:
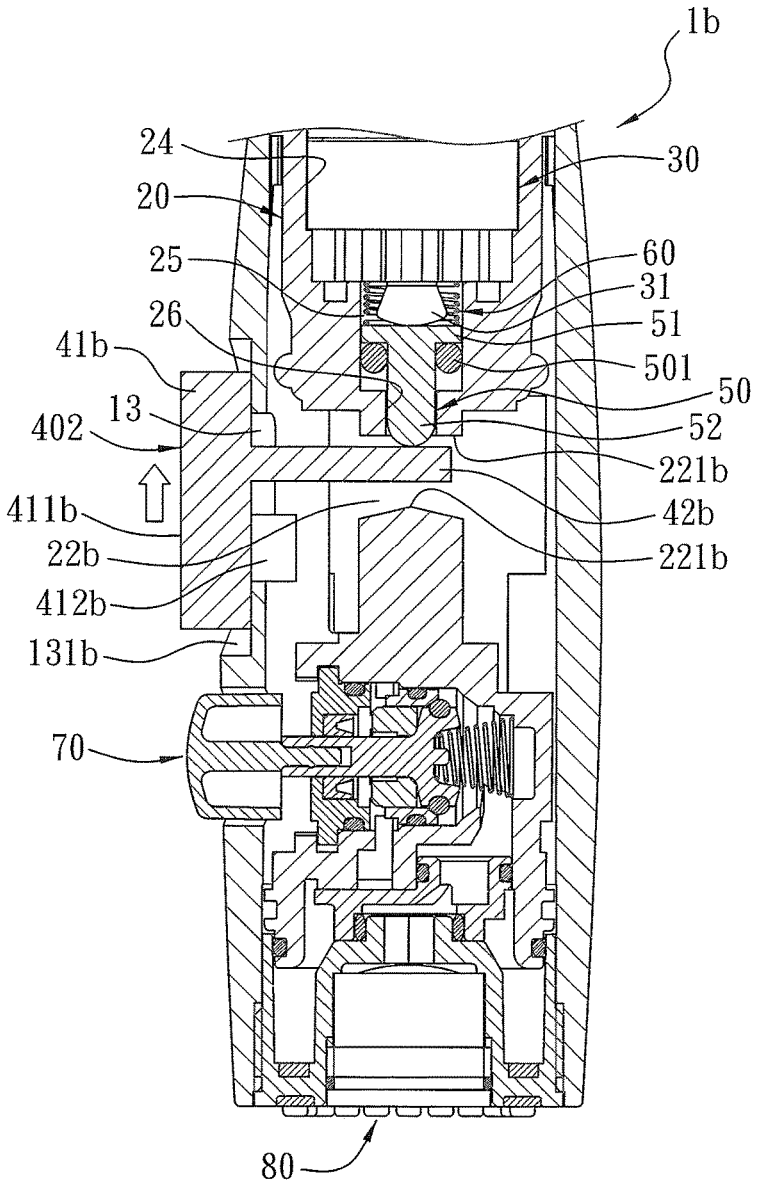
FIG. 31 is a cross sectional view showing the operation of the touch spray head according to the third embodiment of the present invention.

As illustrated in FIGS. 23 and 31, the second orifice 22*b* of the fixing cylinder 20 has two opposite limiting fringes 221*b* formed therein so that the drive stem 42*b* of the pushing button 402 moves between the two opposite limiting fences 221 after pushing and releasing the pushing button 402. When the pushing button 402 is not pushed, it is located on a bottom of the first trench 131*b*; when the external face 411*b* of the pushing button 402 is pushed upward, the pushing button 402 moves upward along the first trench 131*b* of the positioning portion 1*b* so that the drive stem 42*b* upward removes from the two opposite limiting fences 221*b* to push the push column 50 upward, and the push column 50 touches the operation bar 31 of the water valve 30, thus starting water supply, as shown in FIG. 31.

With reference to FIGS. 32-35, a difference of a touch spray head 1*c* of a fourth embodiment from that of the first embodiment comprises:

an accommodating chamber 22*c* formed in the receiving zone 203 of the fixing cylinder 20; the accommodating chamber 22*c* having a first opening 231*c* formed on a peripheral fence 23*c* of the accommodating chamber 22*c*.

Figure 46:
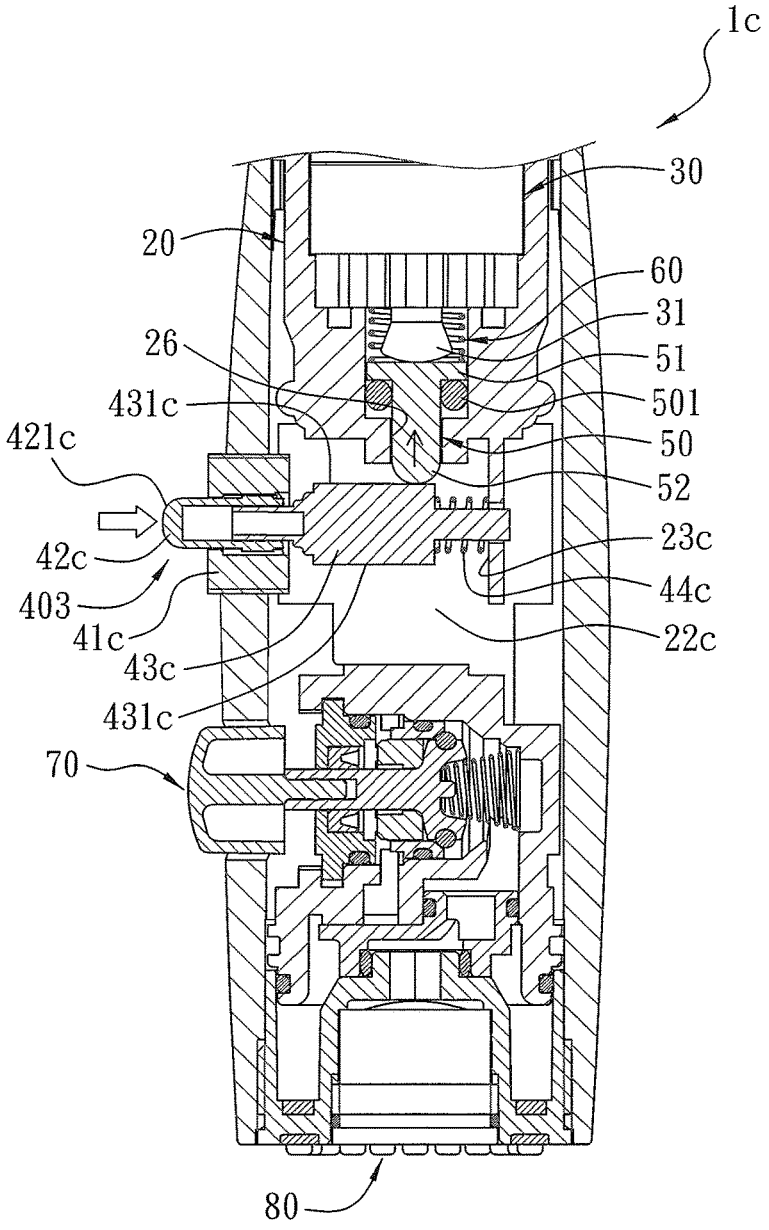
FIG. 46 is a cross sectional view showing the operation of the touch spray head according to the fourth embodiment of the present invention.
Figure 47:
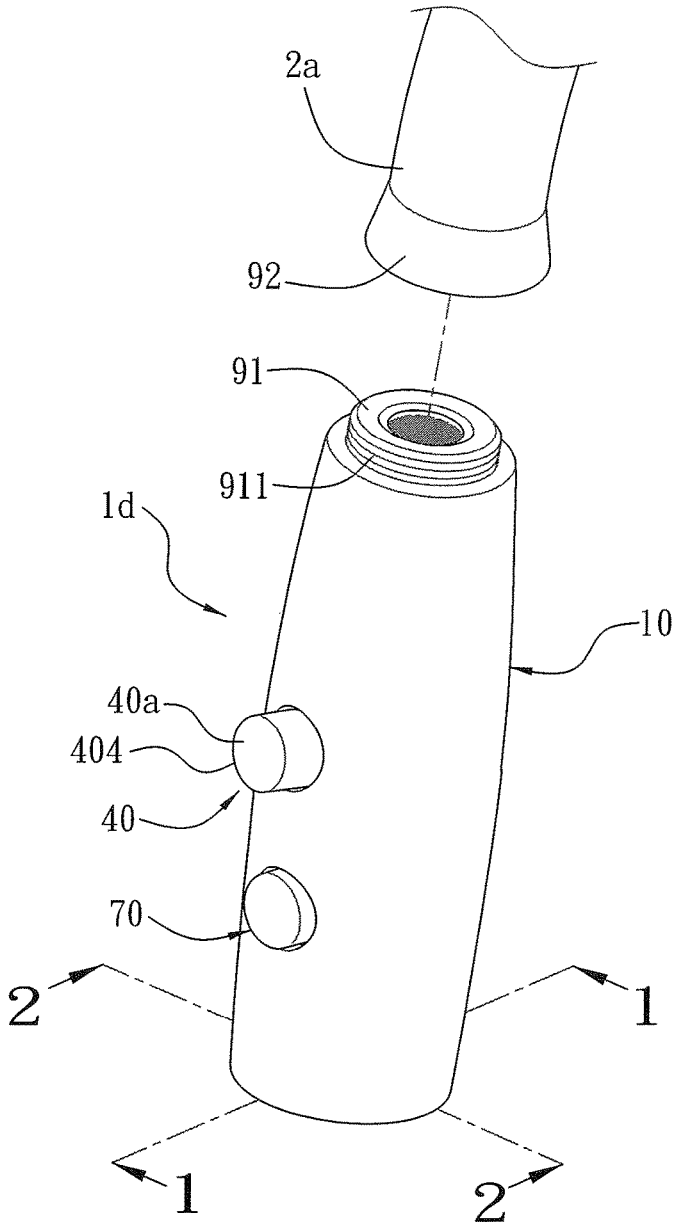
FIG. 47 is a perspective view showing the application of a part of the touch spray head according to a fifth embodiment of the present invention.

As shown in FIGS. 38-41, the manual operation device 40 is a rotation device 403, and the rotation device 403 includes a tubular part 41*c* accommodated in the through hole 13; a press member 42*c* fitted in the tubular part 41*c*, wherein the press member 42*c* has a force exerting segment 421*c* configured to form the driving portion 40*a*, an abutting segment 422*c*, a second opening 423*c* defined in the press member 42*c*; a rotating member 43*c* rotatably connected with the first opening 231*c* of the fixing cylinder 20 and the second opening 423*c* of the press member 42*c*, wherein the rotating member 43*c* has an action zone 430*c* formed on an outer wall thereof, and the action zone 430*c* has multiple acting portions 431*c* and multiple non-acting portions 432*c* which are spaced from one another by the multiple acting portions 431 respectively, wherein the multiple acting portions 431*c* are configured to drive the operation bar 31 of the water valve 30 to move, as illustrated in FIG. 46, and each of the multiple non-acting portions 432*c* is configured to remove the operation bar 31; a resilient element 44*c* configured to elastically push the rotating member 43*c*; and a toothed drive mechanism 45*c* housed in the tubular part 41*c*, formed on the abutting segment 422*c* of the press member 42*c*, and connecting with the rotating member 43*c*. When the pressing segment 421*c* of the press member 42*c* is pressed and released, the abutting segment 422*c* pushes the rotating member 43*c* to move a distance, and the resilient element 44*c* matches with the toothed drive mechanism 45*c* to push the resilient element 44*c*, hence after the rotating member 43*c* revolves in a travel, it stops rotation, wherein in the travel, the rotating member 43*c* drives the operation bar 31 by using a non-acting portion 432*c*, an acting portion 431*c* adjacent to the non-acting portion 432*c*, a next non-acting portion 432*c* relative to the operation bar 31, and a next acting portion 431*c* with respect to the operation bar 31.

Figure 33:
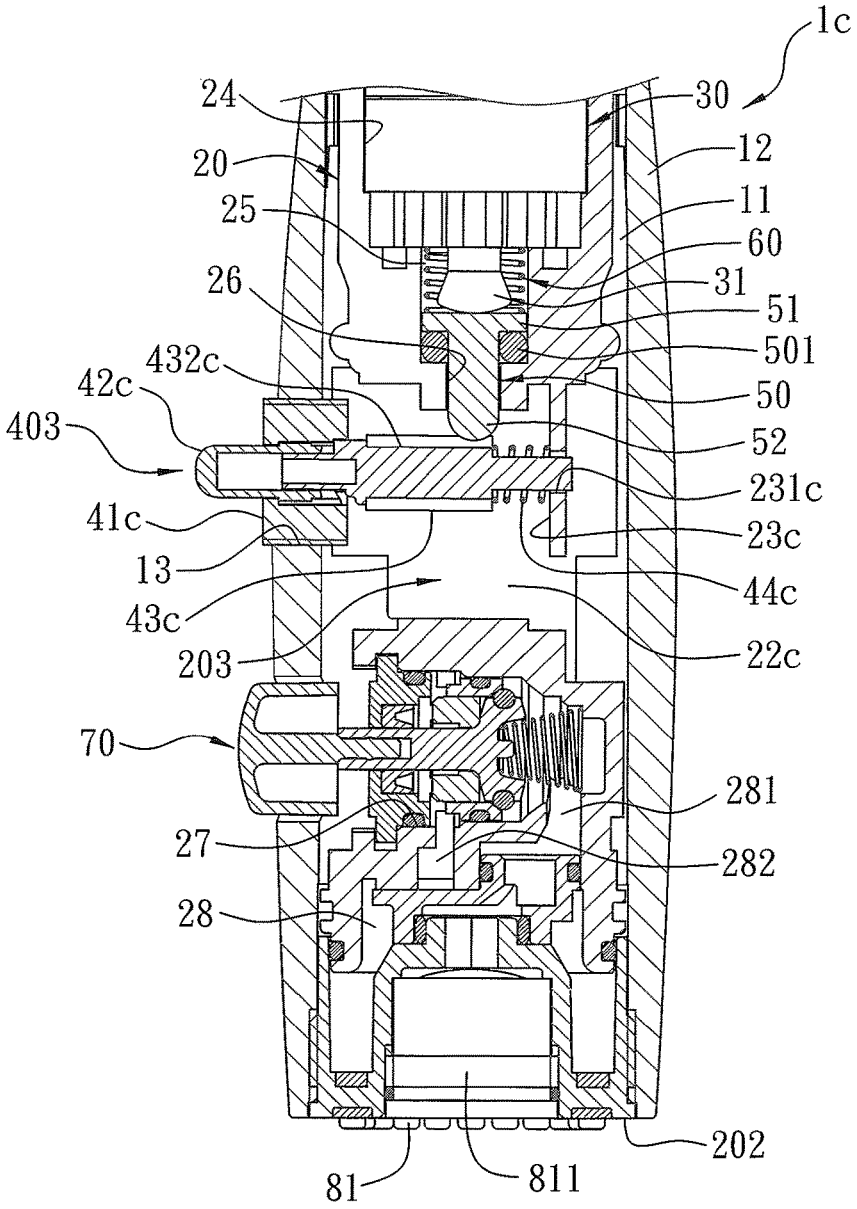
FIG. 33 is a cross sectional view taken along the line 1-1 of a part of FIG. 32.
Figure 34:
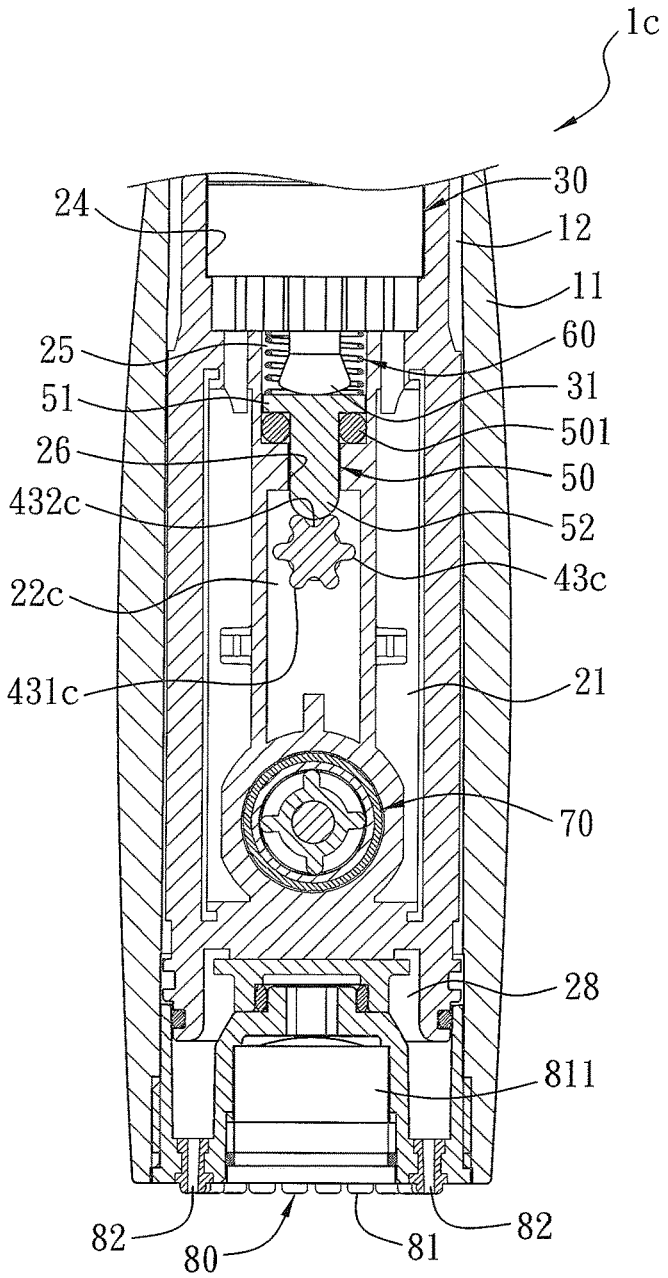
FIG. 34 is a partial cross-sectional view taken along the line 2-2 of a part of FIG. 32.
Figure 35:
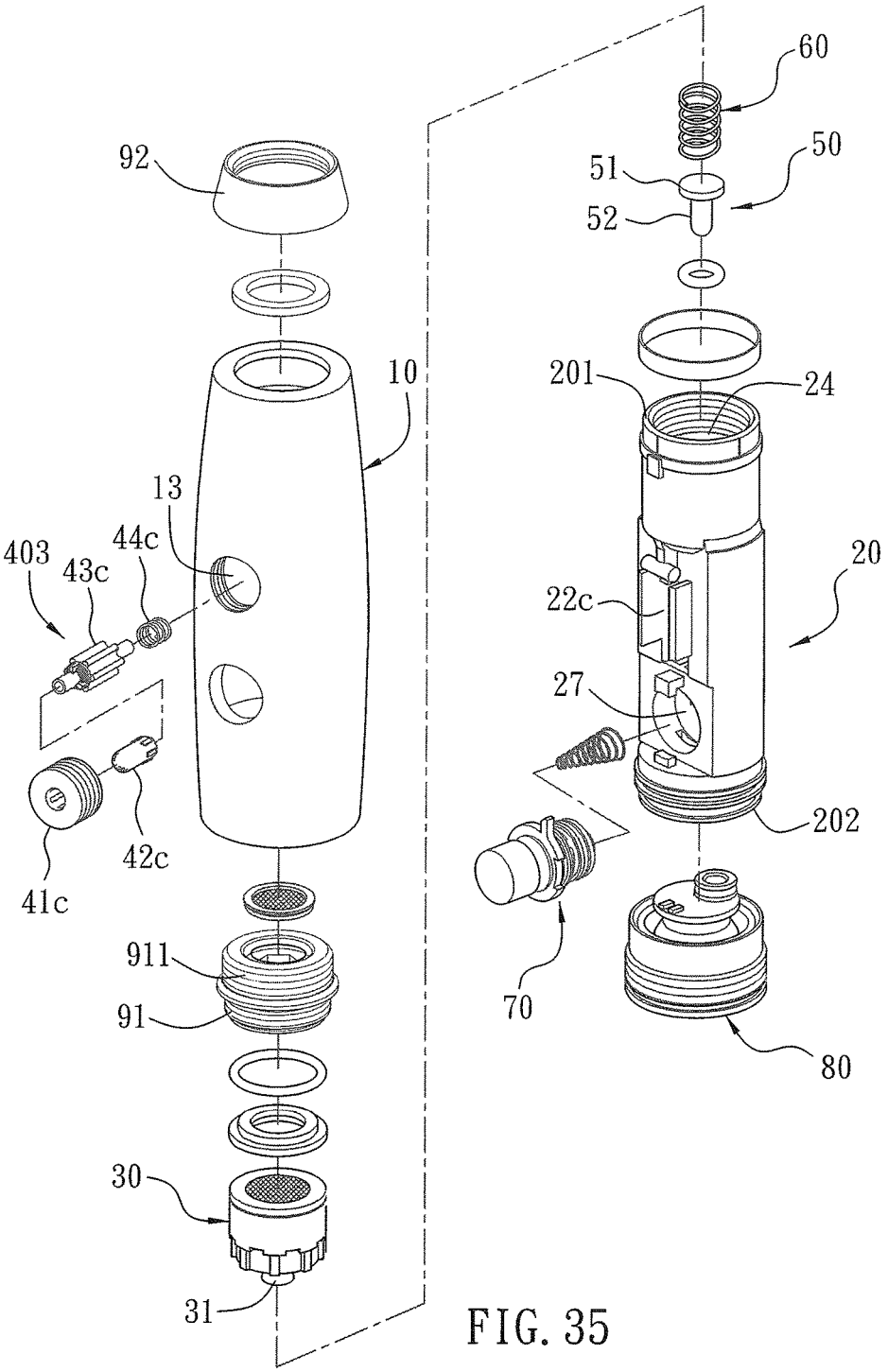
FIG. 35 is a perspective view showing the exploded components of the touch spray head according to the fourth embodiment of the present invention.

As illustrated in FIGS. 33-35, the acting portion 431*c* of the rotation device 403 actuates the operation bar 31 via the push column 50.

As shown in FIG. 35, the through hole 13 of the casing 10 is a screwing hole, the tubular part 41*c* of the rotation device 403 has outer threads for screwing with the screwing hole of the casing 10.

Figure 32:
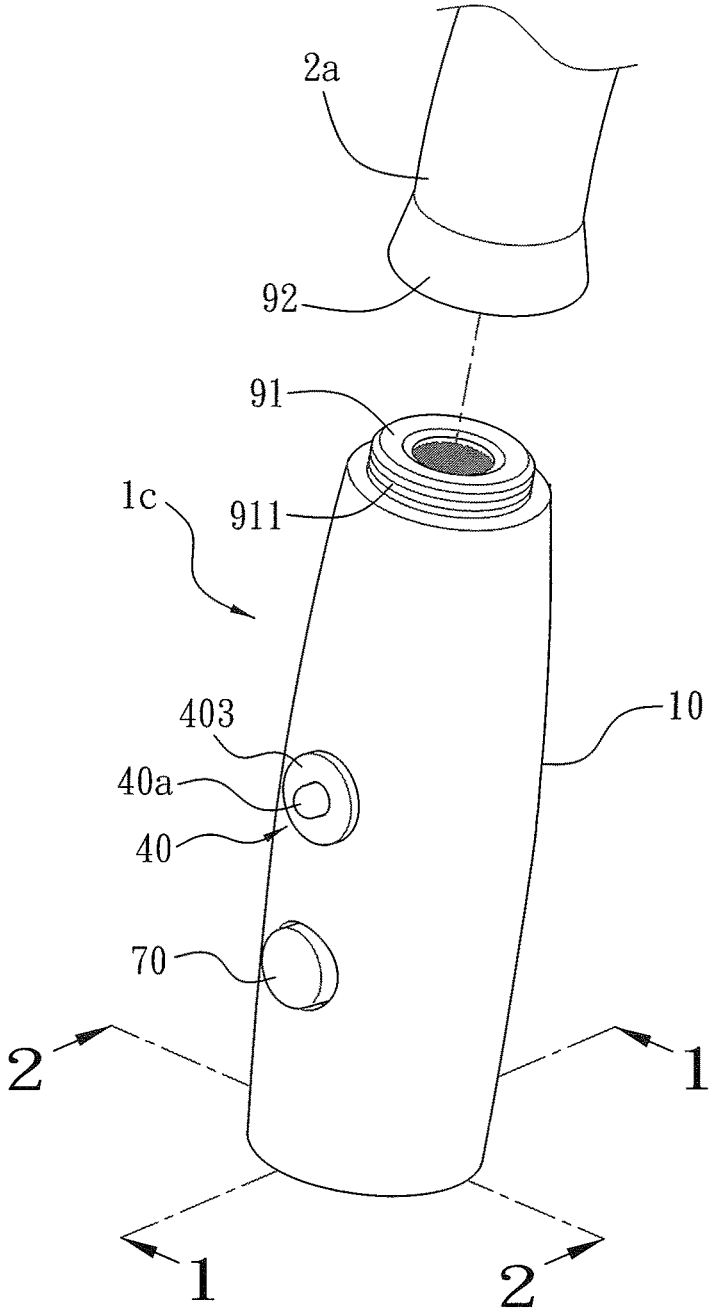
FIG. 32 is a perspective view showing the application of a part of the touch spray head according to a fourth embodiment of the present invention.
Figure 38:
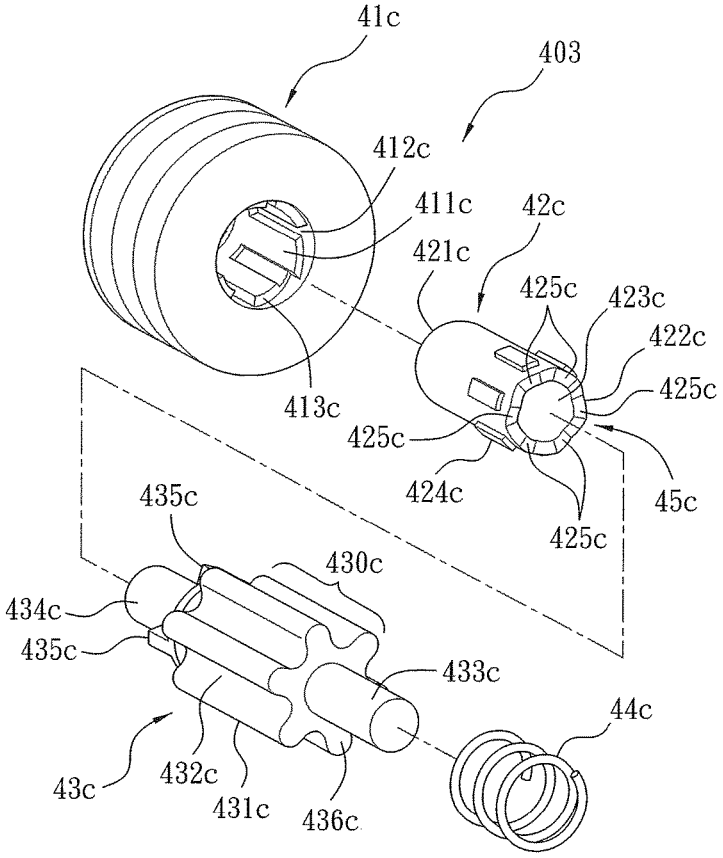
FIG. 38 is a perspective view showing the exploded components of a rotation device of the touch spray head according to the fourth embodiment of the present invention.
Figure 39:
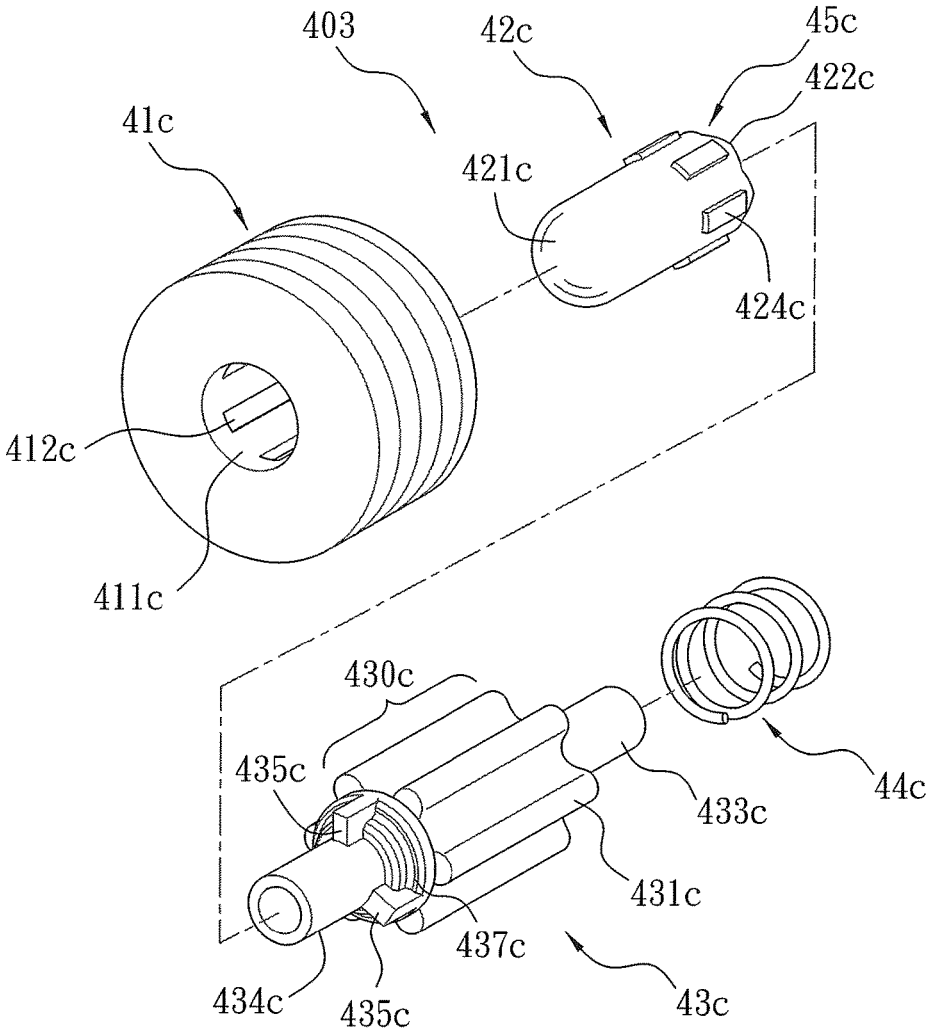
FIG. 39 is another perspective view showing the exploded components of the rotation device of the touch spray head according to the fourth embodiment of the present invention.
Figure 40:
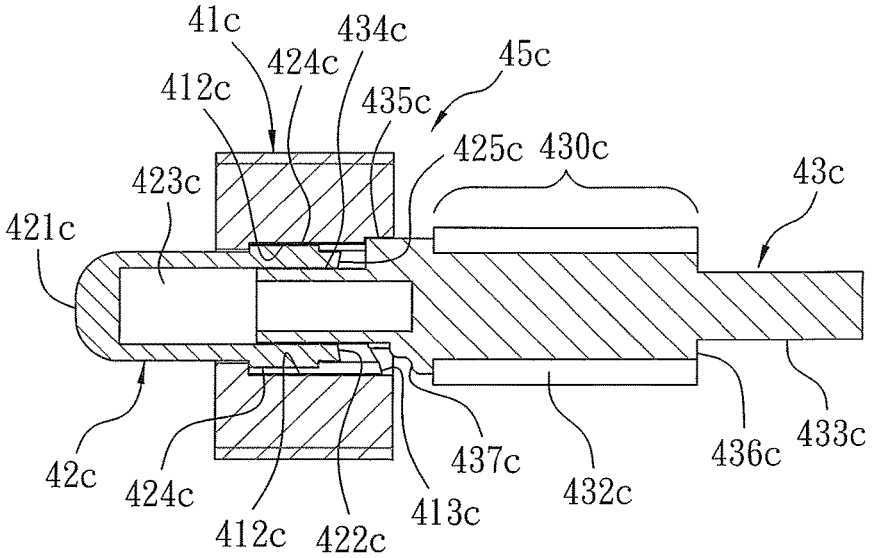
FIG. 40 is a cross sectional view showing the operation of the rotation device of the touch spray head according to the fourth embodiment of the present invention.
Figure 41:
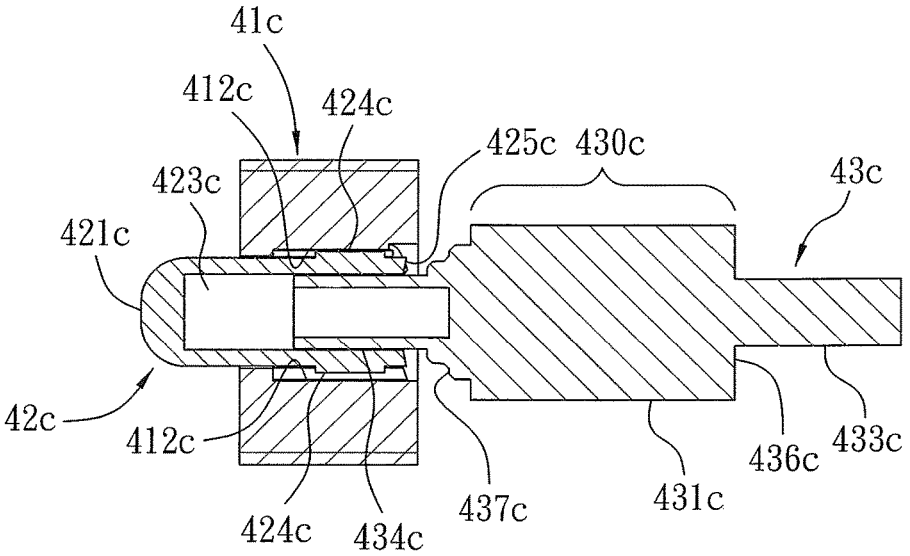
FIG. 41 is another cross sectional view showing the operation of the rotation device of the touch spray head according to the fourth embodiment of the present invention.
Figure 42:
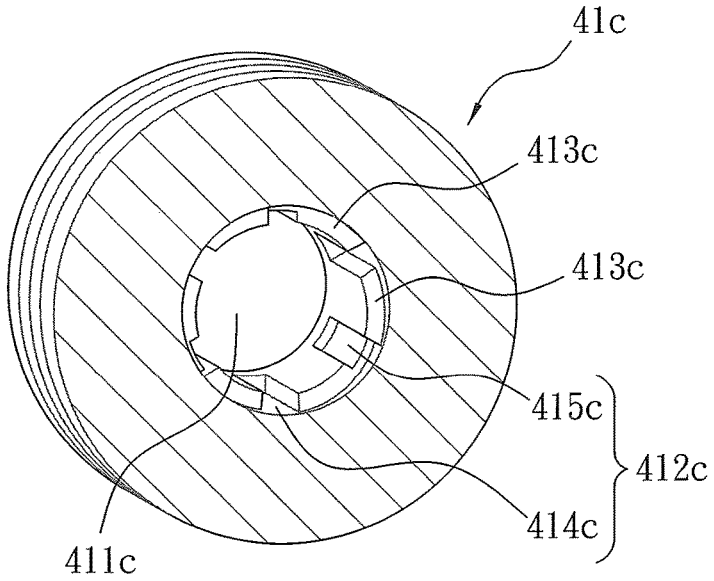
FIG. 42 is a cross-sectional perspective view showing the assembly of a tubular part of the touch spray head according to the fourth embodiment of the present invention.
Figure 43:
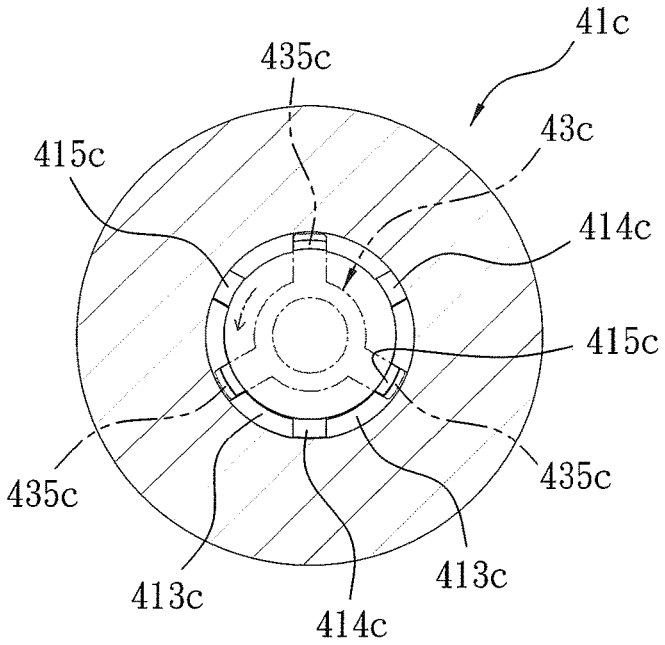
FIG. 43 is a cross sectional view showing the operation of a part of the touch spray head according to the fourth embodiment of the present invention.
Figure 44:
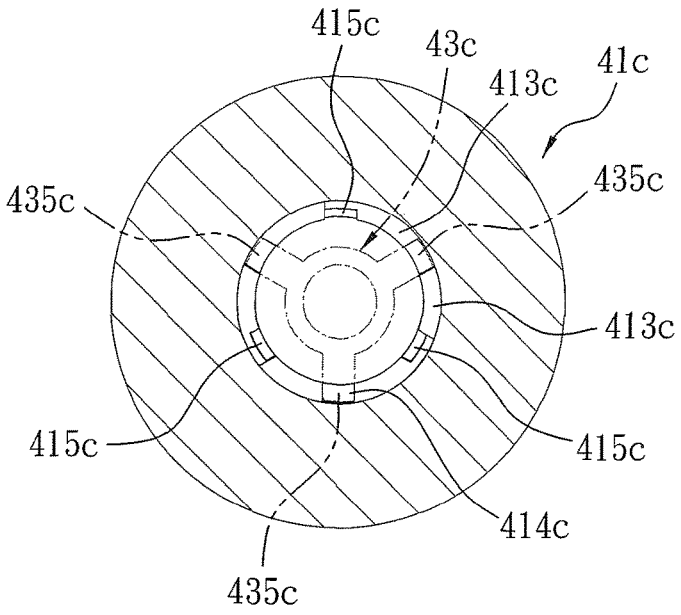
FIG. 44 is another cross sectional view showing the operation of a part of the touch spray head according to the fourth embodiment of the present invention.
Figure 45:
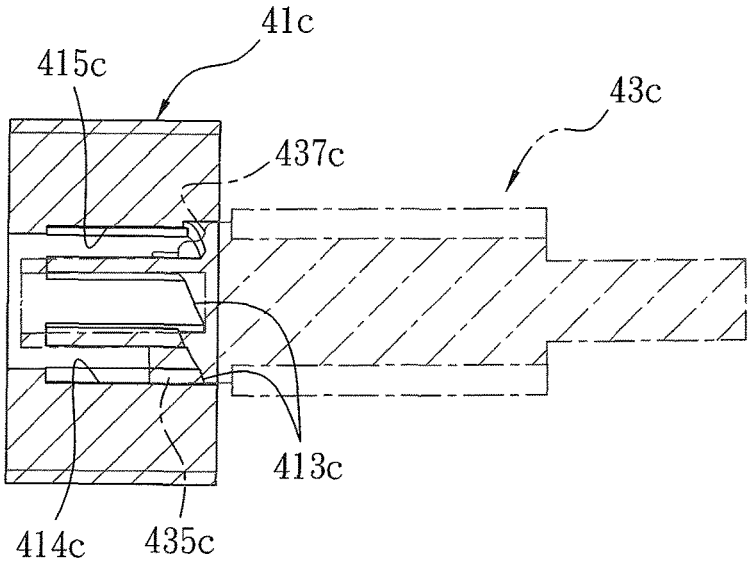
FIG. 45 is also another cross sectional view showing the operation of a part of the touch spray head according to the fourth embodiment of the present invention.

Referring to FIG. 32, the tubular part 41*c* has an aperture 411*c* defined therein, multiple troughs 412*c* separately arranged on an inner wall of the first aperture 411*c*, and multiple tilted positioning teeth 413*c*. As shown in FIGS. 38-40, the press member 42*c* is fitted in the aperture 411*c* of the tubular part 41*c*, the press member 42*c* includes a plurality of slide protrusions 424*c* formed on an outer wall thereof and slidably retained with the multiple troughs 412*c* respectively, and the press member 42*c* includes multiple tilted actuating teeth 425*c* formed on the abutting segment 422*c*; the rotating member 43*c* has a first post 433*c* extending outwardly from a first end thereof and rotatably fitted with the first opening 231*c* of the fixing cylinder 20, a second post 434*c* extending outwardly from a second end of the rotating member 43*c* and rotatably fitted with the second opening 423*c* of the press member 42*c*, the action zone 430*c* formed between the first post 433*c* and the second post 434*c*, and multiple tilted driven teeth 435*c* arranged between the action zone 430*c* and the second post 434*c*. The toothed drive mechanism 45*c* is comprised of the multiple tilted positioning teeth 413*c* of the tubular part 41*c*, and the multiple tilted actuating teeth 425*c* of the press member 42*c*, and the multiple tilted driven teeth 435*c* of the rotating member 43*c*.

When the press member 42*c* is pressed to move or is released, the multiple tilted actuating teeth 425*c* push the multiple tilted driven teeth 435*c* of the rotating member 43*c* to move away from the multiple tilted positioning teeth 413*c* of the tubular part 41*c*, and the resilient element 44*c* pushes the multiple tilted driven teeth 435*c* to rotatably fix on the multiple tilted positioning teeth 413*c* individually, hence the rotating member 43*c* rotates in the travel.

Figure 36:
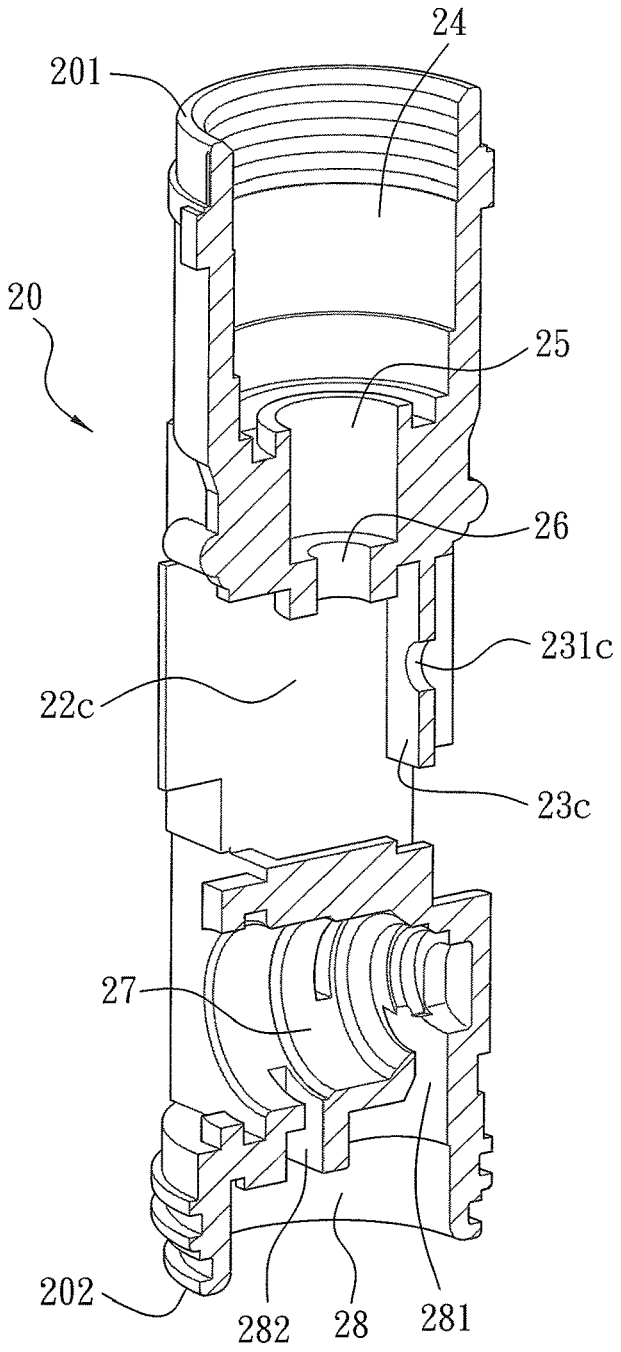
FIG. 36 is a cross-sectional perspective view showing the assembly of a fixing cylinder of the touch spray head according to the fourth embodiment of the present invention.
Figure 37:
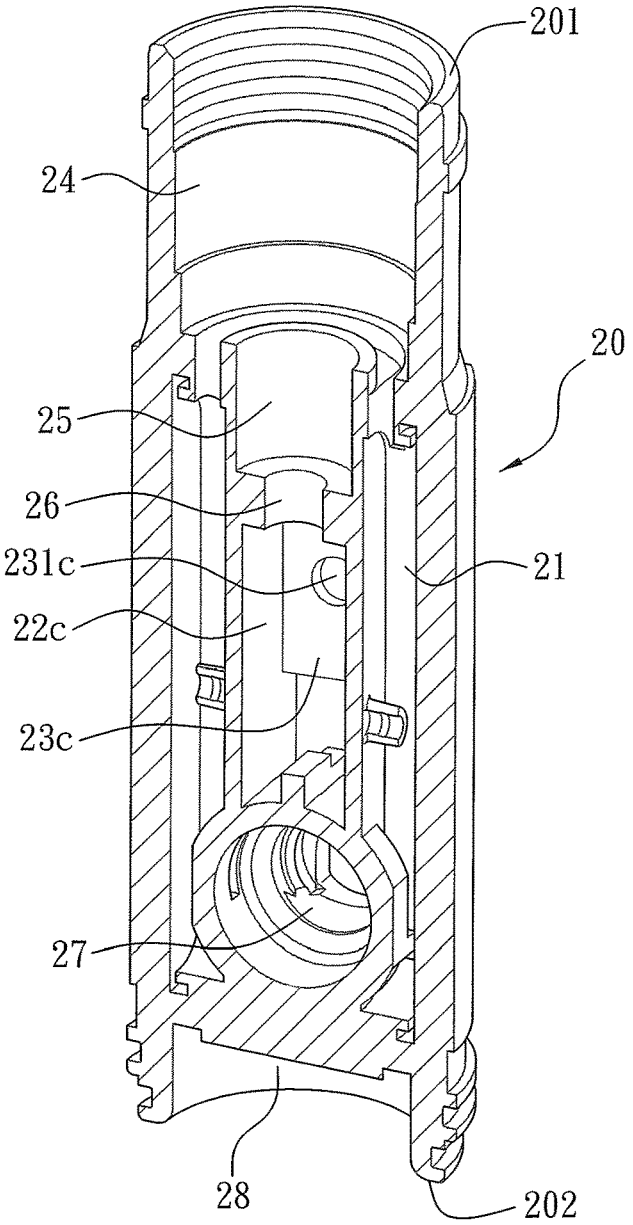
FIG. 37 is a cross-sectional perspective view showing the assembly of the fixing cylinder of the touch spray head according to the fourth embodiment of the present invention.

Each of the multiple acting portions 431*c* is an elongated rib; each of the multiple non-acting portions 432*c* is an elongated slot, and the multiple acting portions 431*c* abut against the operation bar 31 of the water valve 30 via the push column 50, when the press member 42*c* is pressed or is released, as shown in FIG. 36.

Furthermore, each non-acting portion 432*c* is configured to remove the operation bar 31 from the push column 50.

After pressing and releasing the press member 42*c*, the press member 42*c* moves back to an original position by way of the resilient element 44*c* and the toothed drive mechanism 45*c*, and the rotating member 43*c* moves back to the multiple non-acting portions 432*c* relative to the push column 50.

In this embodiment, the resilient element 44*c* is a compression spring and is fitted on the second post 434*c* of the rotating member 43*c*, wherein a first end of the resilient element 44*c* abuts against a part of the peripheral fence 23*c* of the fixing cylinder 20, and a second end of the resilient element 44*c* is biased against a stop cliff 436*c* between the action zone 430*c* and the first post 433*c*, as illustrated in FIG. 8.

With reference to FIG. 32, the tubular part 41*c* has six troughs 412*c* and six tilted positioning teeth 413*c*, wherein an inner end of each of the six troughs 412*c* is defined by a lowest portion of each of the six tilted positioning teeth 413*c*. The press member 42*c* has six slide protrusions 424*c* and six tilted driving teeth 425*c*. The rotating member 43*c* has three tilted driven teeth 435*c*, wherein tilting directions and slopes of the six tilted positioning teeth 413*c*, the six tilted driving teeth 425*c*, and the three tilted driven teeth 435*c* are identical, hence after the press member 42*c* is pressed and is released, the rotating member 43*c* revolves in a travel of 60 degrees, for example, the rotating member 43*c* revolves from an imaginary position of the FIG. 33 to an imaginary position of FIG. 34. In other words, when the rotating member 43*c* revolves in a circle, it means that the rotating member 43*c* revolves in six travels, and each of the six travels is 60 degrees.

Referring to FIGS. 32-34, the six troughs 412*c* of the tubular part 41*c* has three deep troughs 414*c* and three shallow troughs 415*c* which are spaced from one another respectively, wherein the three tilted driven teeth 435*c* of the rotating member 43*c* slide into the three deep troughs 414*c* individually, as shown on the imaginary position of FIG. 34. The rotating member 43*c* has three limitation cliff 437*c* spaced from one another by the three tilted driven teeth 435*c* respectively, hence after the three tilted driven teeth 435*c* slide into the three deep troughs 414*c* individually, the three tilted driven teeth 435*c* are fixed by the three limitation cliff 437*c* and the six tilted positioning teeth 413*c* respectively, as illustrated in FIG. 35.

In addition, a distal end of the extension 52 of the push column 50 is driven by the multiple acting portions 431*c* of the rotating member 43*c*.

Referring to FIGS. 33-35, the touch spray head 1*c* further comprises a compression spring 60 configured to push the push column 50 to move back to an original position, after the rotating member 43*c* rotates in every travel.

With reference to FIGS. 47-50, a difference of a touch spray head 1*d* of a fifth embodiment from that of the first embodiment comprises:

an accommodation chamber 22*d* formed in the receiving zone 203 of the fixing cylinder 20.

Figure 48:
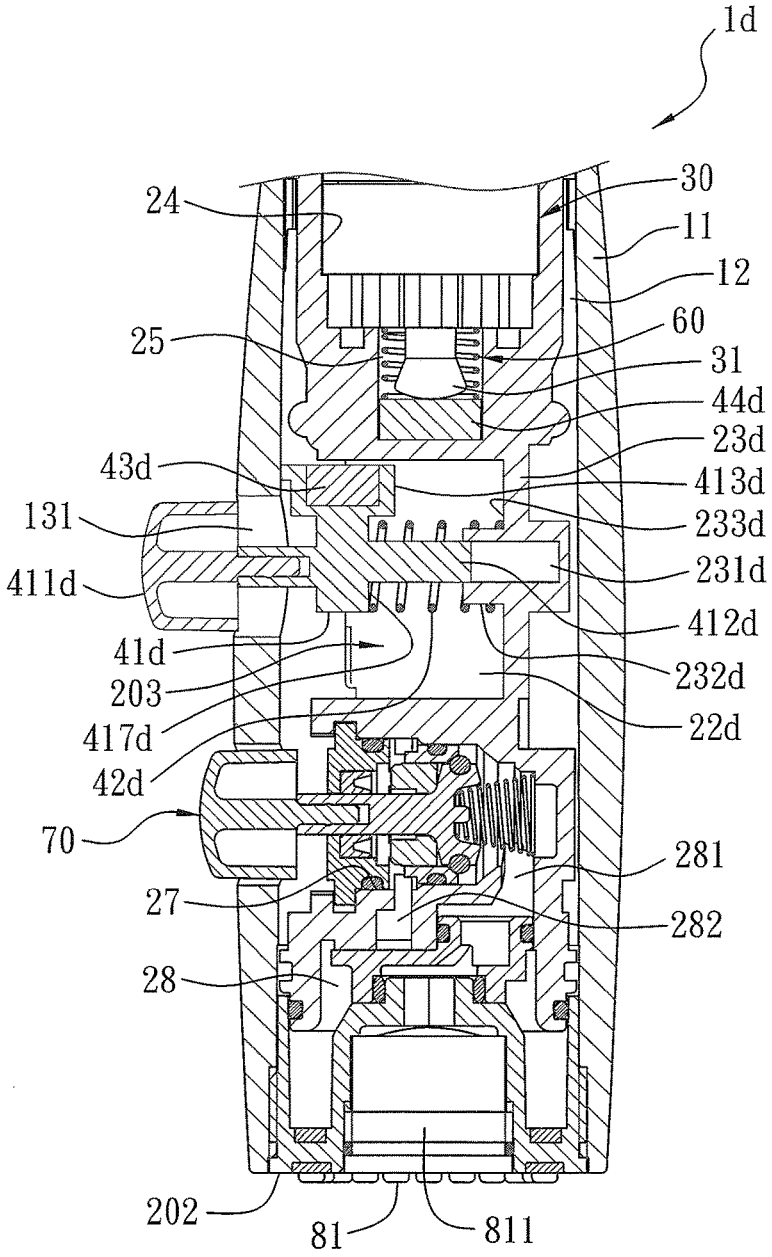
FIG. 48 is a cross sectional view taken along the line 1-1 of a part of FIG. 47.
Figure 49:
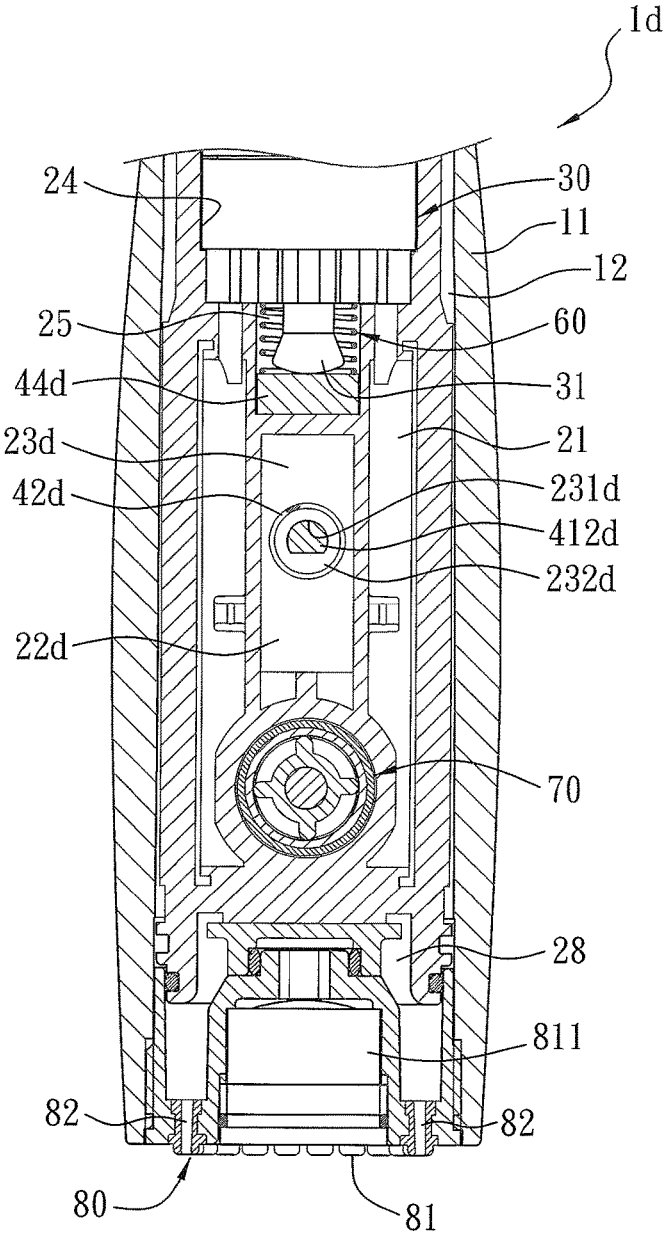
FIG. 49 is a cross sectional view taken along the line 2-2 of a part of FIG. 47.
Figure 50:
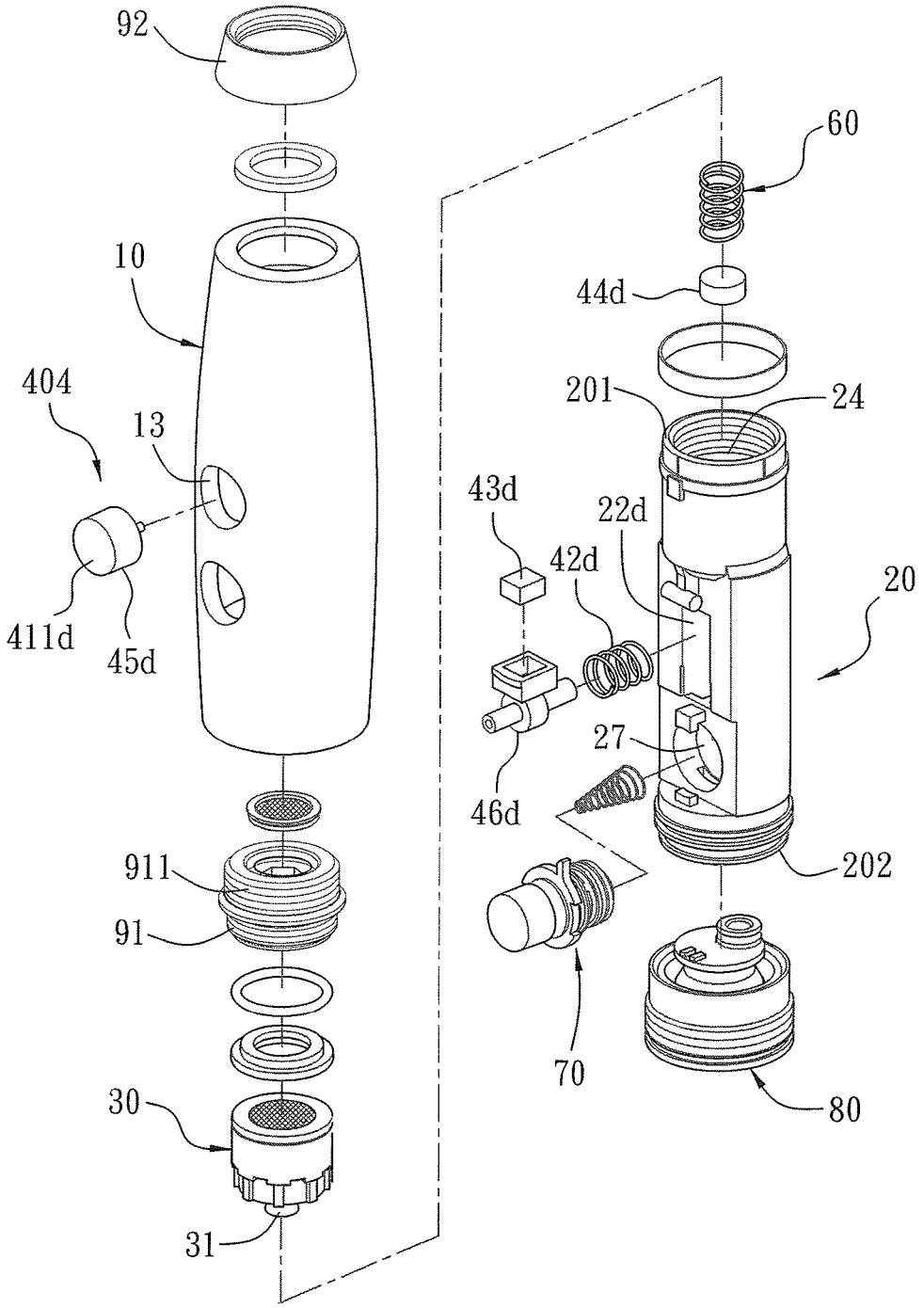
FIG. 50 is a perspective view showing the exploded components of a touch spray head according to a fifth embodiment of the present invention.
Figure 53:
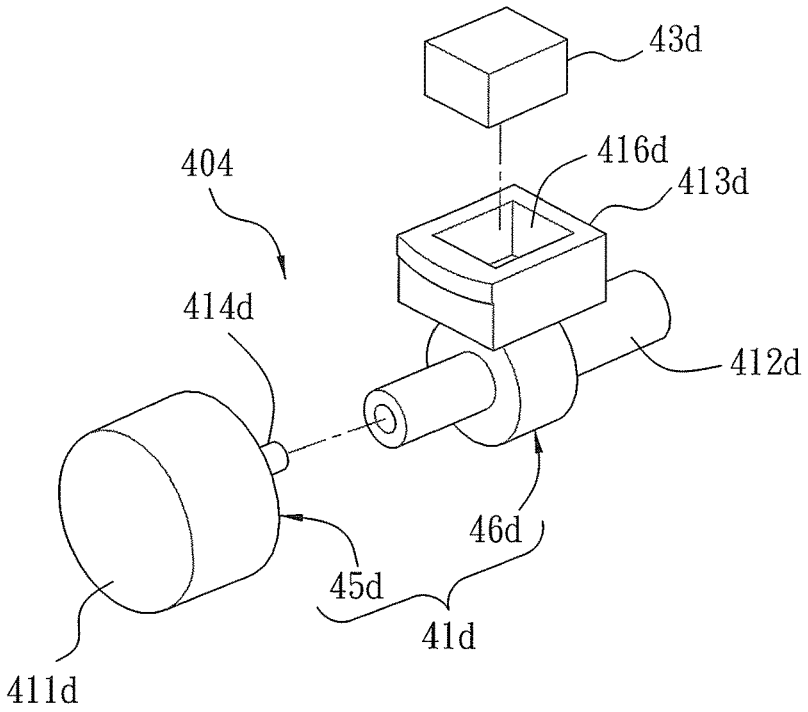
FIG. 53 is a perspective view showing the exploded components of a magnetic drive device of the touch spray head according to the fifth embodiment of the present invention.
Figure 54:
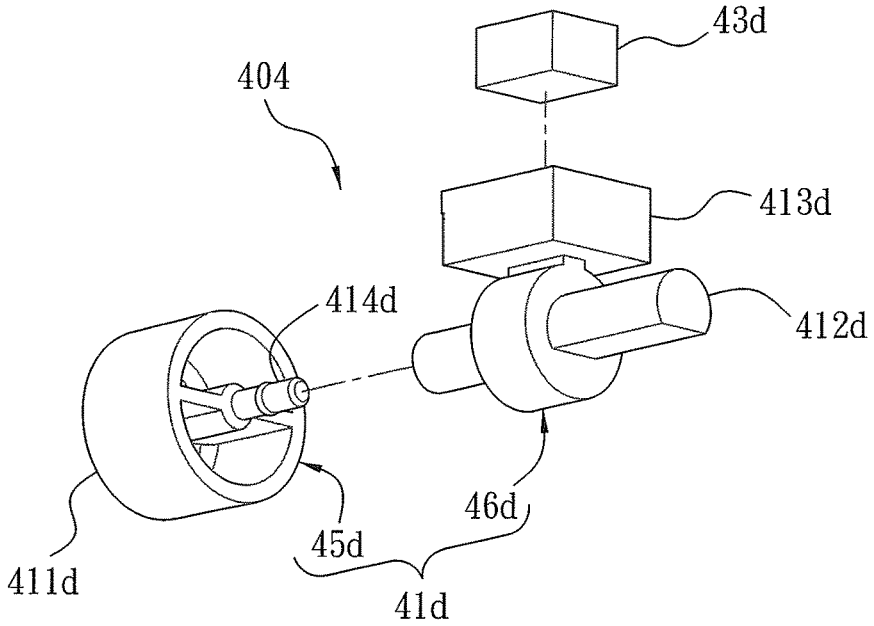
FIG. 54 is another perspective view showing the exploded components of the magnetic drive device of the touch spray head according to the fifth embodiment of the present invention.
Figure 55:
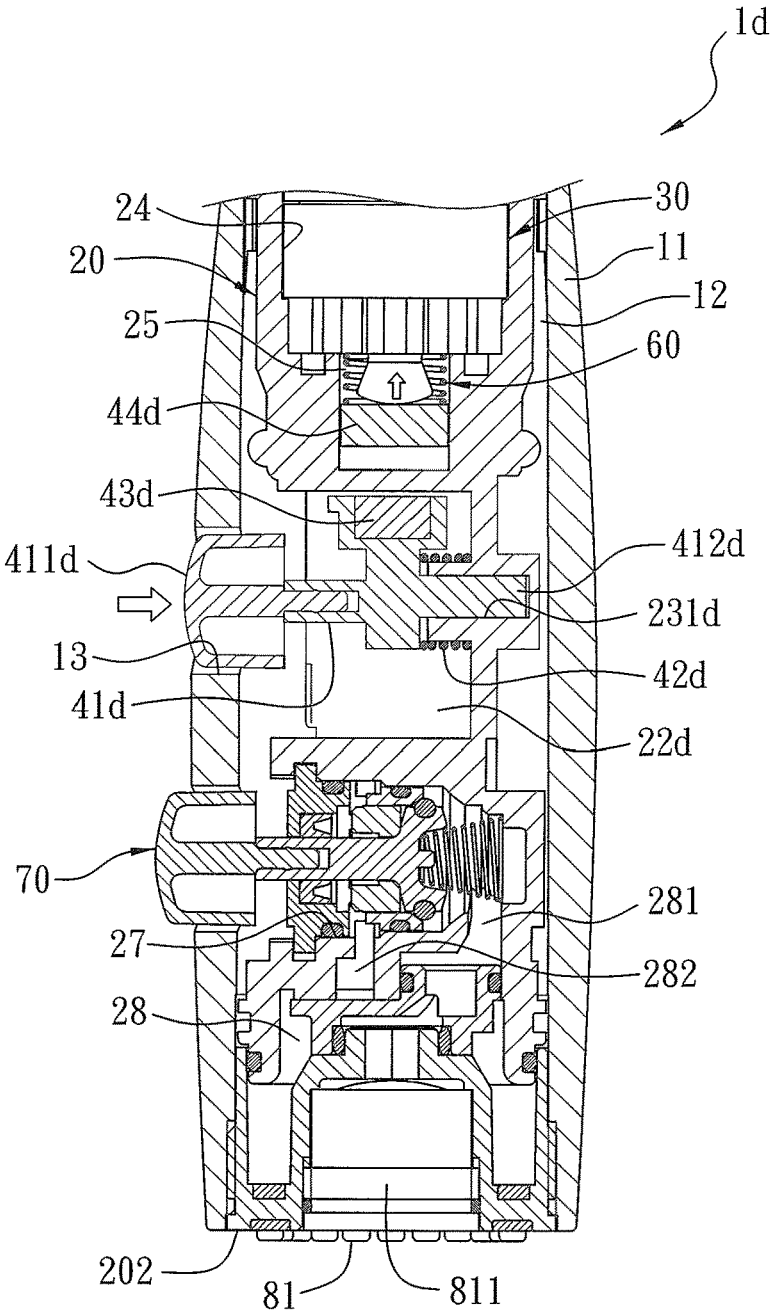
FIG. 55 is a cross sectional view showing the operation of the touch spray head according to the fifth embodiment of the present invention.

Referring to FIGS. 50, 53, and 54, the manual operation device 40 is a magnetic drive device 404 which includes a moving portion 41*d* housed in the accommodation chamber 22*d* and moving between a pressing position and a releasing position, wherein the moving portion 41*d* has a urging section 411*d* extending out of the through hole 13 of the casing 10 so as to be pressed by the user; an elastic element 42*d* configured to elastically act on the moving portion 41*d* so that the moving portion 41*d* stays at the pressing portion or returns back to the releasing position, as shown in FIG. 48; a first magnetic element 43*d* fixed on the moving portion 41*d*; a second magnetic element 44*d* movably accommodated in the fixing cylinder 20 and opposite to the operation bar 31 of the water valve 30, wherein when the moving portion 41*d* is pressed to move to the pressing position, it is magnetically driven by the second magnetic element 44*d* to touch the operation bar 30 to move, as shown in FIG. 55.

Figure 51:
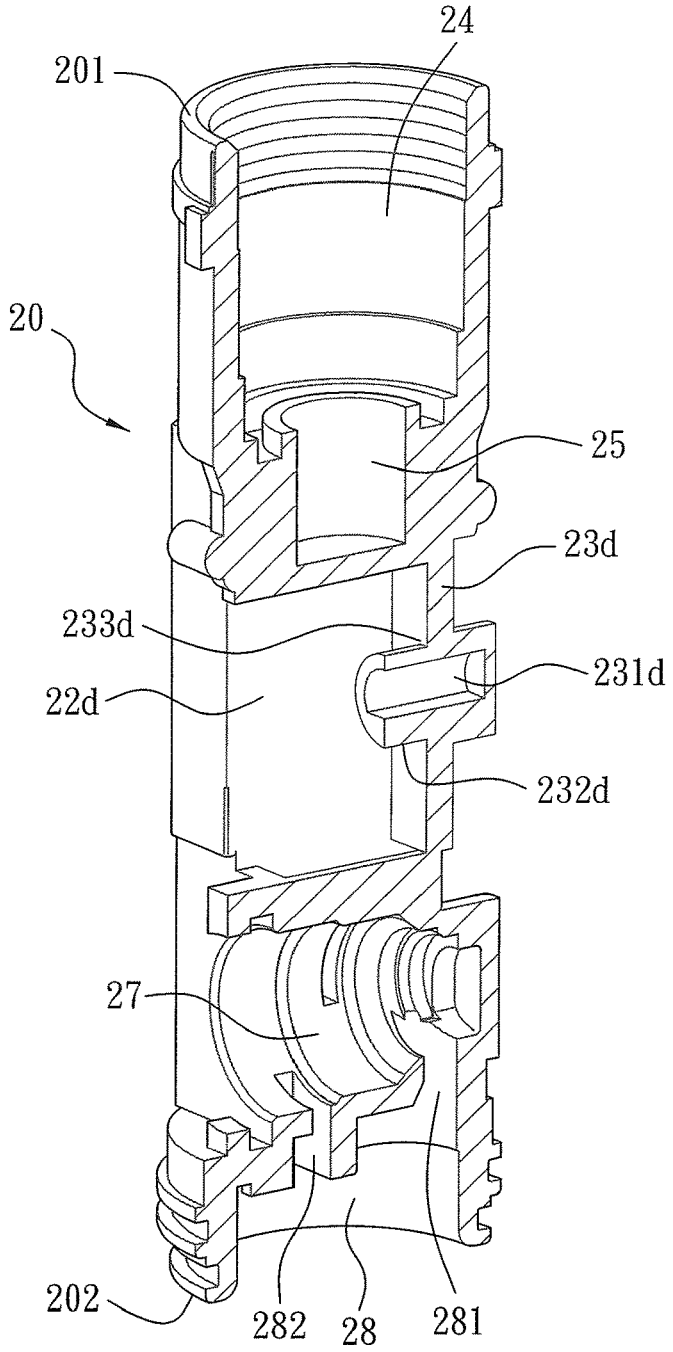
FIG. 51 is a cross-sectional perspective view showing the assembly of a fixing cylinder of the touch spray head according to the fifth embodiment of the present invention.
Figure 52:
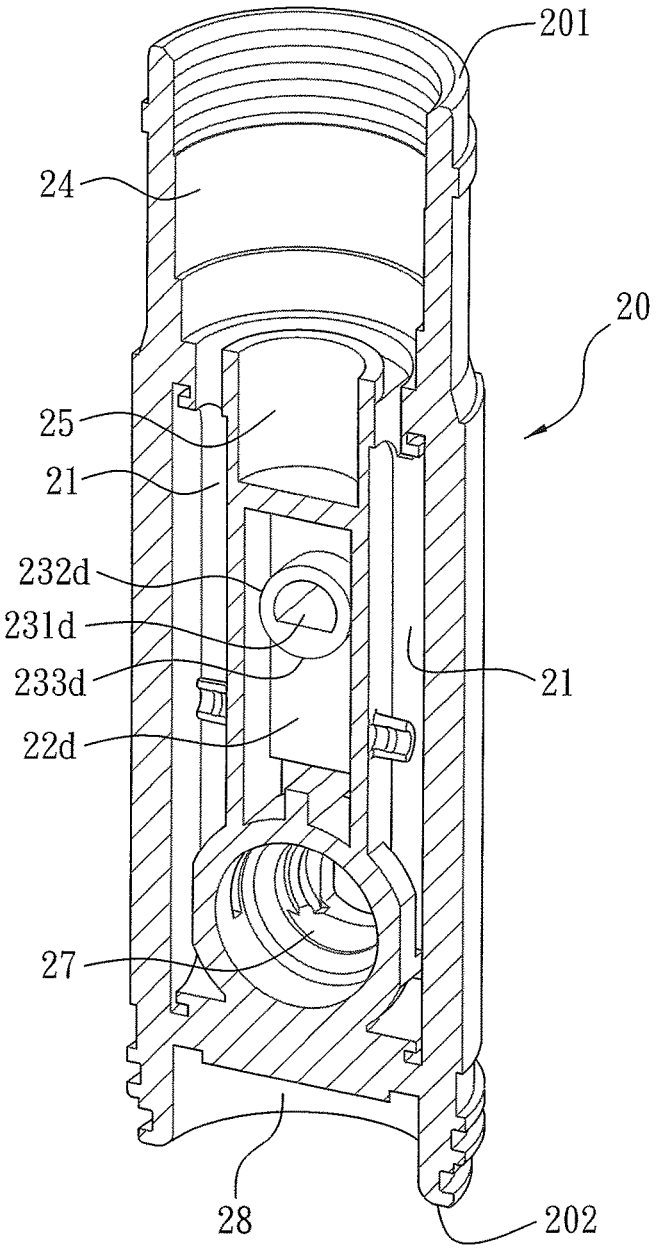
FIG. 52 is another cross-sectional perspective view showing the assembly of the fixing cylinder of the touch spray head according to the fifth embodiment of the present invention.

As shown in FIGS. 51-52, the second magnetic element 44*d* is accommodated in the groove 25 opposite to the operation bar 31.

When the moving portion 41*d* is located at the pressing position, the first magnetic element 43*d* closes to the second magnetic element 44*d* so as to repel against the second magnetic element 44*d*, hence the second magnetic element 44*d* is driven to movably touch the operation bar 31, as illustrated in FIG. 55. When the moving portion 41*d* is located at the releasing position, the first magnetic element 43*d* moves away from the second magnetic element 44*d* so as to decrease or vanish repulsion force between the first magnetic element 43*d* and the second magnetic element 44*d*, hence the second magnetic element 44*d* removes from the operation bar 31, as shown in FIG. 48.

Each of the first magnetic element 43*d* and the second magnetic element 44*d* is a magnet so that the first magnetic element 43*d* repels against the second magnetic element 44*d*, hence the second magnetic element 44*d* is driven to move back to an original position.

With reference to FIGS. 48 and 51, the accommodation chamber 22*d* has a guiding trench 231*d* defined thereon, the moving portion 41*d* has a press member 45*d* and a slider 46*d* connecting with the press member 45*d*; the press member 45*d* has the urging section 411*d* formed thereon; the slider 46*d* has a slidable peg 412*d* rotatably retained and moving in the guiding trench 231*d*, and the slider 46*d* has a mounting portion 413*d* configured to fix the first magnetic element 43*d*. The guiding trench 231*d* includes a first tangent plane formed on an inner wall thereof, and the slidable peg 412*s* has a second tangent plane formed on an outer wall thereof and mating with the first tangent plane, thus limiting rotation of the slider 46*d*. Thereafter, the first magnetic element 43*d* moves close to or away from the second magnetic element 44*d* straightly and does not rotate.

Referring to FIGS. 48, 53, and 54, the press member 45*d* has an extending segment 414*d* extending from the urging section 411*d*; the slider 46*d* has a first cutout 415*d* configured to accommodate the extending segment 414*d*, and the mounting portion 413*d* further has a second cutout 416*d* configured to house the first magnetic element 43*d*; the mounting portion 413*d* abuts against a part of the housing 10 inside an outer rim of the through hole 13 of the casing 10 so as to fix the moving portion 41*d* at the releasing position.

The moving portion 41*d* has a first biasing fringe 417*d* defined on one side thereof opposite to a distal end of the slidable peg 412*d*; the fixing cylinder 20 further includes an affixing tube 232*d* and a second biasing fringe 233*d* which are formed on the guiding trench 231*d* of the accommodation chamber 22*d*; the elastic element 42*d* is a compression spring fitted on the slidable peg 412*d* of the slider 46*d* and the affixing tube 232*d*, and two ends of the elastic element 42*d* abut against the first biasing fringe 417*d* and the second biasing fringe 233*d* respectively.

Referring to FIGS. 48 and 50, the compression spring 60 is accommodated in the groove 25 between the water valve 30 and the second magnetic element 44*d* so as to decrease or vanish repulsion force between the first magnetic element 43*d* and the second magnetic element 44*d*, hence the first magnetic element 43*d* and the second magnetic element 44*d* move back to original positions individually.

When the water valve is automatic, the operation bar 31 is driven to move so as to flow the water. Thereafter, the water valve moves back to an original position and turn off the water, hence turning off the water by pressing the driving portion 40*a* of the manual operation device 40 is not required.

When the water valve 30 is not automatic, it is turned off by manually pressing the driving portion 40*a* of the manual operation device 40.

Thereby, the operation bars 31 of the water valves 30 of the touch spray heads 1, 1*a*, 1*b*, 1*c*, 1*d* are driven by operating the driving portion 40*a* of the manual operation devices 40, thus starting/stopping the water supply easily and saving water consumption.

The water valves 30 of the touch spray heads 1, 1*a*, 1*b*, 1*c*, 1*d* are driven by operating the manual operation devices 40 so as to avoid manually touching and contaminating the water valves 30.

The touch spray heads 1 spray the water in different water spraying modes by way of the switch valve assemblies 70.

The pressing button 400 of the touch spray head 1 of the first embodiment is rotatably connected with the fixing cylinder 20 directly so as to simplify the touch spray head 1 and reduce fabrication cost.

Figure 56:
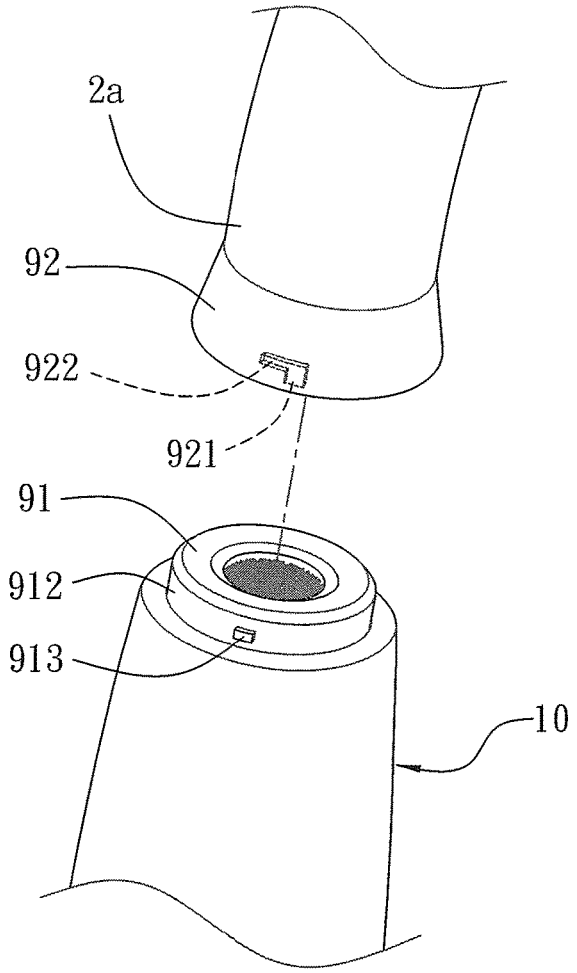
FIG. 56 is a perspective view showing the exploded components of a part of the touch spray head according to the first, second, third, fourth, and fifth embodiments of the present invention respectively.

The inflow connectors 91 of the outlets 2*a* of the touch spray heads 1, 1*a*, 1*b*, 1*c*, 1*d* are screwed with the screw sleeves 92 respectively. Alternatively, each inflow connector 91 has a protruded section 912 formed thereon and has at least one engagement projection 913 arranged around an outer wall of the protruded section 912, as shown in FIG. 56, and each screw sleeve 92 has at least first indentation 921 defined on an inner wall thereof and has at least one second indentation 922 communicating with the at least one first indentation 921 so that the protruded section 912 of each inflow 91 extends out of the top of the casing 10, and the at least one engagement projection 913 rotates into the at least one first indentation 921 and retains in the at least one second indentation 922, thus connecting/removing each screw sleeve 92 with/from each inflow connector 91 quickly so as to replace or maintain each touch spray head 1, 1*a*, 1*b*, 1*c*, 1*d* freely.

While the preferred embodiments of the invention have been set forth for the purpose of disclosure, modifications of the disclosed embodiments of the invention as well as other embodiments thereof may occur to skilled in the art. Accordingly, the appended claims are intended to cover all embodiments which do not depart from the spirit and scope of the invention.

What is claimed is:

1. A touch spray head being removably connected on an outlet of a faucet body and comprising:

a casing including a surrounding fence, an accommodation space defined inside the surrounding fence, and a through hole formed on the surrounding fence and communicating with the accommodation space;

a fixing cylinder housed in the accommodation space of the casing and including an inlet segment communicating with the outlet of the faucet body, an outlet segment, at least one first orifice defined between the inlet segment and the outlet segment, and a receiving zone;

a water valve accommodated in the fixing cylinder and including an operation bar touched to movably turn on the water valve so that the water flows into the at least one first orifice of the fixing cylinder from the outlet of the faucet body;

a manual operation device housed in the receiving zone of the fixing cylinder and the through hole of the casing, and the manual operation device including a driving portion formed in the through hole so as to be driven by a user to actuate the operation bar of the water valve to move;

a switch valve assembly arranged on the fixing cylinder and configured to switch to water spraying mode; and a water spray set;

wherein the switch valve assembly is pressed so as to guide the water to the water spray set from the at least one first orifice, thus producing at least two water spraying modes;

wherein the fixing cylinder includes a first trench communicating with the at least one first one orifice so as to fix the switch valve assembly in the first trench; the fixing cylinder further includes a second trench for accommodating the water spray set, wherein the second trench has a central channel and a peripheral channel communicating with the first trench; the water spray set includes a first aperture communicating with the central channel so as to spray the water out of the first aperture in the central spraying mode, and the water spray set includes multiple second apertures communicating with the peripheral channel so as to spray the water from the multiple second apertures in the peripheral spraying mode.

2. The touch spray head as claimed in claim 1, wherein the fixing cylinder further includes a second orifice formed in the receiving zone and includes a first connection portion; the manual operation device includes a pressing button which has a force portion and a drive stem extending from the force portion; a part of the drive stem is limited in the second orifice of the fixing cylinder; the force portion has an external face and an internal face, wherein the external face has an operating zone configured to form the driving portion, the internal face has a second connection portion rotatably connected with the first connection portion and being opposite to the driving portion in relation to the drive stem, hence when the operating zone is pressed, the drive stem in the second orifice touches the operation bar of the water valve to move by way of the first connection portion and the second connection portion.

3. The touch spray head as claimed in claim 2, wherein the fixing cylinder further includes a receiving cavity located on the inlet segment, a groove formed in the receiving cavity, and a third orifice passing through the groove, wherein the at least one first orifice communicates with the receiving cavity and the outlet segment; the water valve is accommodated in the receiving cavity, and the operation bar is housed in the groove.

4. The touch spray head as claimed in claim 3 further comprising a push column extending out of the groove from the third orifice and pushing the drive stem of the pressing button to actuate the operation bar.

5. The touch spray head as claimed in claim 4, wherein the push column includes a fitting portion sliding in the groove, and the push column includes an extension extending out of the third orifice from the fitting portion; the fitting portion is configured to drive the operation bar of the water valve; a distal end of the extension is driven by the drive stem of the pressing button.

6. The touch spray head as claimed in claim 5 further comprising a compression spring accommodated in the groove between the water valve and the fitting portion of the push column so that the push column and the pressing button are pushed by the compressing spring to move back to original positions respectively.

7. The touch spray head as claimed in claim 5, wherein the extension of the push column has a seal washer fitted thereon and contacting with the groove so as to avoid water leakage out of the third orifice from the groove.

8. The touch spray head as claimed in claim 2, wherein the first connection portion of the fixing cylinder is at least one rotary shaft; the second connection portion of the pressing button is at least one rotatable tab configured to retain with the at least one rotary shaft.

9. The touch spray head as claimed in claim 8, wherein the first connection portion is a rotary shaft, and the second connection portion is two rotatable tabs.

10. The touch spray head as claimed in claim 2, wherein the second orifice of the fixing cylinder has two opposite limiting fringes defined therein so that when the drive stem of the pressing button is pressed and released, the drive stem moves between the two opposite limiting fringes.

11. The touch spray head as claimed in claim 2, wherein the second connection portion of the pressing button is opposite to the operating zone of the pressing button.

12. The touch spray head as claimed in claim 1, wherein the water spray set is configured to flow the water in a central spraying mode and a peripheral spraying mode.

13. The touch spray head as claimed in claim 1, wherein the fixing cylinder further includes a receiving cavity located on the inlet segment, a groove formed in the receiving cavity, and the at least one first orifice communicates with the receiving cavity and the outlet segment; the water valve is accommodated in the receiving cavity, and the operation bar is housed in the groove.

14. The touch spray head as claimed in claim 13 further comprising an inflow connector screwed in the receiving cavity, and the inflow connector having a threaded connecting portion extending out of the casing so as to screw with a screw sleeve on the outlet of the faucet body.

15. The touch spray head as claimed in claim 13 further comprising an inflow connector screwed in the receiving cavity, and the inflow connector has a threaded connecting portion extending out of the casing, wherein the inflow connector has a protruded section formed thereon and has at least one engagement projection arranged around an outer wall of the protruded section and rotatably retained in a screw sleeve formed on the outlet of the faucet body.

16. A touch spray head being removably connected on an outlet of a faucet body and comprising:

a casing including a surrounding fence, an accommodation space defined inside the surrounding fence, and a through hole formed on the surrounding fence and communicating with the accommodation space;

a fixing cylinder housed in the accommodation space of the casing and including an inlet segment communicating with the outlet of the faucet body, an outlet segment, at least one first orifice defined between the inlet segment and the outlet segment, and a receiving zone;

a water valve accommodated in the fixing cylinder and including an operation bar touched to movably turn on the water valve so that the water flows into the at least one first orifice of the fixing cylinder from the outlet of the faucet body;

a manual operation device housed in the receiving zone of the fixing cylinder and the through hole of the casing, and the manual operation device including a driving portion formed in the through hole so as to be driven by a user to actuate the operation bar of the water valve to move;

wherein the fixing cylinder further includes a second orifice formed in the receiving zone and includes a first connection portion; the manual operation device includes a pressing button which has a force portion and a drive stem extending from the force portion; a part of the drive stem is limited in the second orifice of the fixing cylinder; the force portion has an external face and an internal face, wherein the external face has an operating zone configured to form the driving portion, the internal face has a second connection portion rotatably connected with the first connection portion and being opposite to the driving portion in relation to the drive stem, hence when the operating zone is pressed, the drive stem in the second orifice touches the operation bar of the water valve to move by way of the first connection portion and the second connection portion;

wherein the first connection portion of the fixing cylinder is at least one rotary shaft; the second connection portion of the pressing button is at least one rotatable tab configured to retain with the at least one rotary shaft.

17. The touch spray head as claimed in claim 16, wherein the fixing cylinder further includes a receiving cavity located on the inlet segment, a groove formed in a bottom of the receiving cavity, and a third orifice passing through a bottom of the groove, wherein the at least one first orifice communicates with the receiving cavity and the outlet segment; the water valve is accommodated in the receiving cavity, and the operation bar is housed in the groove.

18. A touch spray head being removably connected on an outlet of a faucet body and comprising:

a casing including a surrounding fence, an accommodation space defined inside the surrounding fence, and a through hole formed on the surrounding fence and communicating with the accommodation space;

a fixing cylinder housed in the accommodation space of the casing and including an inlet segment communicating with the outlet of the faucet body, an outlet segment, at least one first orifice defined between the inlet segment and the outlet segment, and a receiving zone;

a water valve accommodated in the fixing cylinder and including an operation bar touched to movably turn on the water valve so that the water flows into the at least one first orifice of the fixing cylinder from the outlet of the faucet body;

a manual operation device housed in the receiving zone of the fixing cylinder and the through hole of the casing, and the manual operation device including a driving portion formed in the through hole so as to be driven by a user to actuate the operation bar of the water valve to move;

a push column extending out of the groove from the third orifice and pushing the drive stem of the pressing button to actuate the operation bar;

a compression spring accommodated in the groove between the water valve and the fitting portion of the push column so that the push column and the pressing button are pushed by the compressing spring to move back to original positions respectively;

wherein the fixing cylinder further includes a second orifice formed in the receiving zone and includes a first connection portion; the manual operation device includes a pressing button which has a force portion and a drive stem extending from the force portion; a part of the drive stem is limited in the second orifice of the fixing cylinder; the force portion has an external face and an internal face, wherein the external face has an operating zone configured to form the driving portion, the internal face has a second connection portion rotatably connected with the first connection portion and being opposite to the driving portion in relation to the drive stem, hence when the operating zone is pressed, the drive stem in the second orifice touches the operation bar of the water valve to move by way of the first connection portion and the second connection portion;

wherein the fixing cylinder further includes a receiving cavity located on the inlet segment, a groove formed in the receiving cavity, and a third orifice passing through the groove, wherein the at least one first orifice communicates with the receiving cavity and the outlet segment; the water valve is accommodated in the receiving cavity, and the operation bar is housed in the groove;

wherein the push column includes a fitting portion sliding in the groove, and the push column includes an extension extending out of the third orifice from the fitting portion; the fitting portion is configured to drive the operation bar of the water valve; a distal end of the extension is driven by the drive stem of the pressing button.

19. A touch spray head being removably connected on an outlet of a faucet body and comprising:

a casing including a surrounding fence, an accommodation space defined inside the surrounding fence, and a through hole formed on the surrounding fence and communicating with the accommodation space;

a fixing cylinder housed in the accommodation space of the casing and including an inlet segment communicating with the outlet of the faucet body, an outlet segment, at least one first orifice defined between the inlet segment and the outlet segment, and a receiving zone;

a water valve accommodated in the fixing cylinder and including an operation bar touched to movably turn on the water valve so that the water flows into the at least one first orifice of the fixing cylinder from the outlet of the faucet body;

a manual operation device housed in the receiving zone of the fixing cylinder and the through hole of the casing, and the manual operation device including a driving portion formed in the through hole so as to be driven by a user to actuate the operation bar of the water valve to move;

wherein the fixing cylinder further includes a receiving cavity located on the inlet segment, a groove formed in a bottom of the receiving cavity, and the at least one first orifice communicates with the receiving cavity and the outlet segment; the water valve is accommodated in the receiving cavity, and the operation bar is housed in the groove;

wherein an inflow connector is screwed in a top of the receiving cavity, and the inflow connector has a threaded connecting portion extending out of a top of the casing, wherein the inflow connector has a protruded section formed thereon and has at least one engagement projection arranged around an outer wall of the protruded section and rotatably retained in a screw sleeve formed on the outlet of the faucet body.

20. A touch spray head being removably connected on an outlet of a faucet body and comprising:

a casing including a surrounding fence, an accommodation space defined inside the surrounding fence, and a through hole formed on the surrounding fence and communicating with the accommodation space;

a fixing cylinder housed in the accommodation space of the casing and including an inlet segment communicating with the outlet of the faucet body, an outlet segment, at least one first orifice defined between the inlet segment and the outlet segment, and a receiving zone;

a water valve accommodated in the fixing cylinder and including an operation bar touched to movably turn on the water valve so that the water flows into the at least one first orifice of the fixing cylinder from the outlet of the faucet body;

a manual operation device housed in the receiving zone of the fixing cylinder and the through hole of the casing, and the manual operation device including a driving portion formed in the through hole so as to be driven by a user to actuate the operation bar of the water valve to move;

wherein the fixing cylinder further includes a receiving cavity located on the inlet segment, a groove formed in the receiving cavity, and the at least one first orifice communicates with the receiving cavity and the outlet segment; the water valve is accommodated in the receiving cavity, and the operation bar is housed in the groove;

wherein an inflow connector is screwed in the receiving cavity, and the inflow connector has a threaded connecting portion extending out of the casing so as to screw with a screw sleeve on the outlet of the faucet body.

* * * * *